US005308046A

United States Patent [19]

Coble

[11] Patent Number: 5,308,046

[45] Date of Patent: May 3, 1994

[54] INSULATED FURNACE DOOR SYSTEM

[76] Inventor: Gary L. Coble, R.D. #2, Box 214, DuBois, Pa. 15801

[21] Appl. No.: 693,346

[22] Filed: Apr. 30, 1991

Related U.S. Application Data

[60] Continuation-in-part of Ser. No. 609,643, Nov. 6, 1990, Pat. No. 5,048,802, which is a continuation-in-part of Ser. No. 373,672, Jun. 28, 1989, abandoned, which is a continuation of Ser. No. 213,699, Jun. 30, 1988, abandoned, which is a continuation-in-part of Ser. No. 907,473, Sep. 15, 1986, Pat. No. 4,755,236, which is a division of Ser. No. 732,400, May 9, 1985, Pat. No. 4,611,791, which is a continuation-in-part of Ser. No. 456,823, Jan. 10, 1983, Pat. No. 4,516,758.

[51] Int. Cl.[5] ..... C21D 1/06

[52] U.S. Cl. ..... 266/263; 266/283; 266/286; 432/250

[58] Field of Search ..... 432/250; 110/173 R, 110/173 C, 172; 266/263, 280, 286, 282, 283, 247

[56] References Cited

U.S. PATENT DOCUMENTS

| | | | |
|---|---|---|---|
| 1,733,647 | 10/1929 | Coghlan | 110/173 C |
| 2,024,649 | 12/1935 | Longenecker | 110/173 |
| 2,148,054 | 2/1939 | Berlek | 266/43 |
| 2,148,281 | 2/1939 | Scott, Jr. | 72/16 |
| 2,231,498 | 2/1941 | Geistler | 266/43 |
| 2,233,650 | 4/1941 | Swartz | 110/180 |
| 2,849,219 | 8/1958 | Boron | 263/40 |

(List continued on next page.)

FOREIGN PATENT DOCUMENTS

| | | | |
|---|---|---|---|
| 0522018 | 2/1956 | Canada | 266/43 |
| 0251908 | 10/1912 | Fed. Rep. of Germany | 432/250 |
| 1106446 | 5/1961 | Fed. Rep. of Germany . | |
| 1131246 | 6/1962 | Fed. Rep. of Germany . | |
| 2928964 | 1/1981 | Fed. Rep. of Germany . | |
| WO810322 | 1/1981 | PCT Int'l Appl. . | |
| 0393333 | 11/1973 | U.S.S.R. | 432/250 |
| 1490129 | 10/1977 | United Kingdom . | |
| 1571789 | 7/1980 | United Kingdom . | |
| 2095382 | 9/1982 | United Kingdom . | |
| 2096752 | 10/1982 | United Kingdom . | |

OTHER PUBLICATIONS

Wahl Refractories, Inc., 4 pages Product Specification for "X-Cel Cast 60" bearing an issue date of Mar. 17, 1988, Fremont, OH 43420.

(List continued on next page.)

*Primary Examiner*—Scott Kastler
*Attorney, Agent, or Firm*—David A. Burge

[57] ABSTRACT

An energy efficient closure system is provided for minimizing heat loss through an elongate, horizontally extending furnace opening that is utilized to admit elongate charges of material, to the interior of a furnace. The system utilizes a plurality of depending, individually mounted, independently pivoted, inwardly curved, insulated door components that are arranged in a side-by-side array and that are biased by gravity so as to normally close the furnace opening. In preferred practice, the system also utilizes a curtain of insulation that depends from a water-cooled support pipe that extends horizontally through the upper part of the door opening, with the curtain being formed by a plurality of depending bats of insulation arranged in a substantially contiguous, side-by-side array. As a slab or other elongate formation of material is moved toward and through the furnace opening, the door components 1) open in response to being engaged by underlying segments of the slab, 2) remain open only to the extent needed to permit passage therebeneath of the underlying slab segments, and 3) close automatically once the underlying slab segments have passed through the furnace opening. As the door components open, they engage and inwardly flex adjacent bat components of the curtain. Door components that are located near opposite ends of the furnace opening preferably are relatively narrow so that, unless the slab is unusually long, one or more of the end components will not be opened by an entering slab.

64 Claims, 7 Drawing Sheets

U.S. PATENT DOCUMENTS

| | | | |
|---|---|---|---|
| 2,998,236 | 8/1961 | Cramer et al. | 263/40 |
| 3,039,754 | 6/1962 | Jones | 263/47 |
| 3,081,074 | 3/1963 | Blackman et al. | 263/47 |
| 3,112,737 | 12/1963 | Reighart | 122/499 |
| 3,149,827 | 9/1964 | Whitten | 263/47 |
| 3,226,899 | 1/1966 | Blickle | 52/506 |
| 3,429,370 | 2/1969 | Blackman | 165/47 |
| 3,606,288 | 9/1971 | Bloom | 266/5 |
| 3,693,955 | 9/1972 | Wald et al. | 266/5 |
| 3,819,468 | 6/1974 | Sauder et al. | 161/152 |
| 3,892,396 | 7/1975 | Monaghan | 266/43 |
| 3,930,916 | 1/1976 | Shelley | 156/71 |
| 3,993,237 | 11/1976 | Sauder et al. | 229/140 |
| 4,055,926 | 11/1977 | Byrd, Jr. | 52/475 |
| 4,120,641 | 10/1978 | Myles | 432/3 |
| 4,194,282 | 3/1980 | Byrd, Jr. | 29/451 |
| 4,218,212 | 8/1980 | Eschenberg et al. | 432/247 |
| 4,222,337 | 9/1980 | Christiansen | 110/336 |
| 4,287,839 | 9/1981 | Severin et al. | 110/331 |
| 4,287,940 | 9/1981 | Corbett, Jr. | 165/48 |
| 4,300,882 | 11/1981 | Werych | 432/247 |
| 4,310,302 | 1/1982 | Thekdi et al. | 432/205 |
| 4,316,603 | 2/1982 | Steffen | 266/282 |
| 4,324,602 | 4/1982 | Davis et al. | 156/71 |
| 4,335,870 | 6/1982 | Diener et al. | 266/193 |
| 4,336,086 | 6/1982 | Rast | 156/71 |
| 4,366,255 | 12/1982 | Lankard | 501/95 |
| 4,367,255 | 1/1983 | Blohm | 428/99 |
| 4,516,758 | 5/1985 | Coble | 266/263 |
| 4,611,791 | 9/1986 | Coble | 266/263 |
| 4,647,022 | 3/1987 | Coble | 266/282 |
| 4,653,171 | 3/1987 | Coble | 29/455 |
| 4,755,236 | 7/1988 | Coble | 148/43 |
| 5,048,802 | 9/1991 | Coble | 266/263 |

OTHER PUBLICATIONS

Babcock & Wilcox, *Saber Bloc-A High Performance Weld-on Module,* Apr. 1982, 4 pages brochure, Augusta, GA 30903.

Johns-Manville, *Application Information Z-Blok Insulation Guide,* Jan. 1980, 20 pages brochure, Denver, CO 80217.

Johns-Manville, *Z-Blok & Cerablanket Application Information,* Sep. 1979 4 pages brochure, Denver, CO 80217.

Johns-Manville, *Z-Blok Refactory Liner Modules For Furnace & Kiln Linings,* Sep. 1979, 4 pages brochure, Denver, CO 80217.

Johns-Manville, *Cera Form Special Shapes,* Jan. 1979, 4 pages brochure, Denver, CO 80217.

Johns-Manville, *Cera Form Boards,* Aug. 1979, 4 pages brochure, Denver, CO 80217.

Johns-Manville, *Z-Blok Refractory Fiber Modules,* Feb. 1981, 6 pages brochure, Denver, CO 80217.

*Iron & Steel Engineer* Magazine, Article entitled "Batch Anneal Modeling Study" by Albert R. Perrin et al, vol. 60, #6, pp. 39–45, Jun. 1983.

Lee Wilson Engineering Co., Inc., 8 pages brochure entitled "Lee Wilson—Fore-Most Engineers & Mfgrs. of Annealing Furnaces . . . ", Jun. 1968, Cleveland, OH 44116.

Lee Wilson Engineering Co., Inc., 4 pages brochure entitled "Annealing Furnace Parts", copyright Dec. 1980, Cleveland, OH 44116.

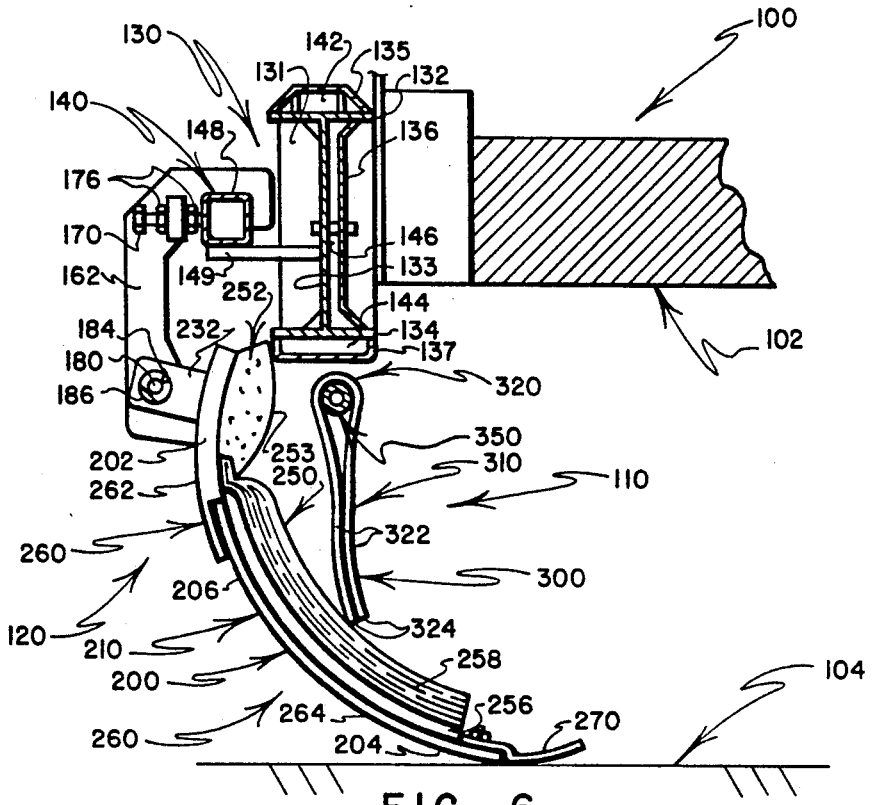
FIG. 6
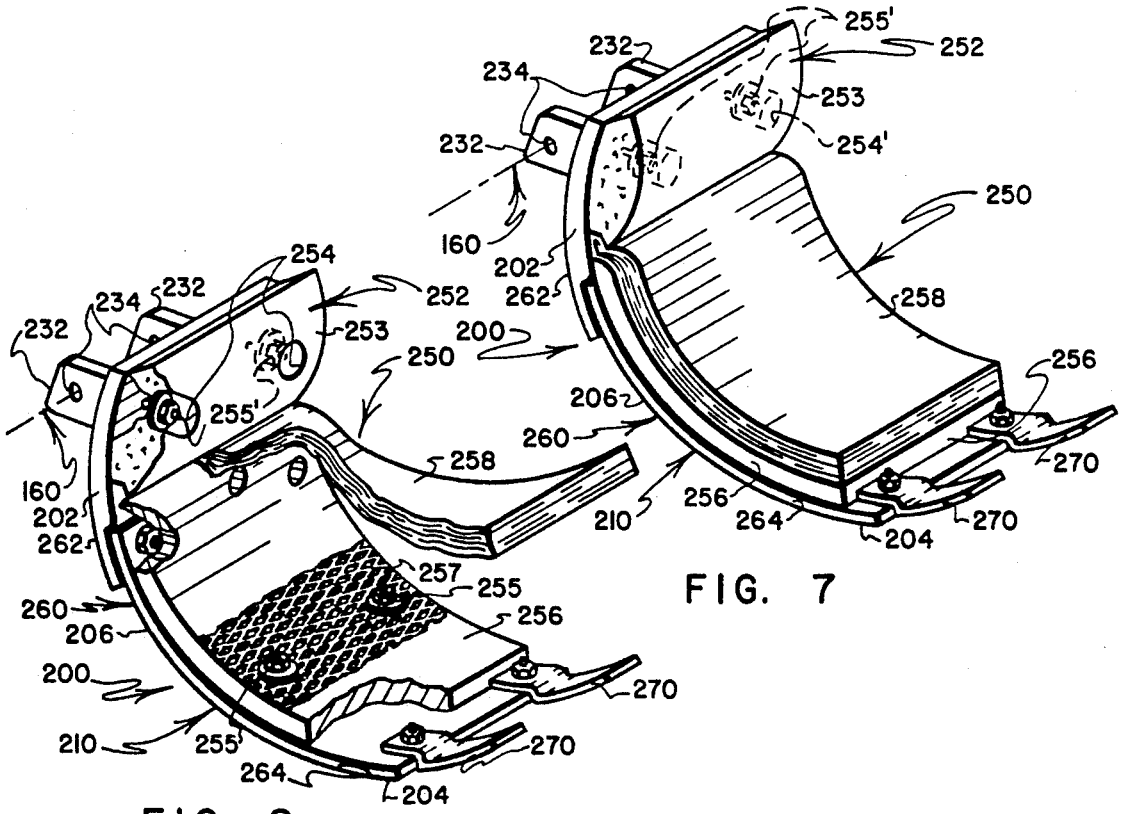
FIG. 7
FIG. 8

INSULATED FURNACE DOOR SYSTEM

CROSS-REFERENCE TO RELATED AND RELEVANT PATENTS AND APPLICATIONS

The present application is a continuation-in-part of application Ser. No. 07/609,643 filed Nov. 6, 1990, referred to hereinafter as the "Parent Convector Plate Case," now U.S. Pat. No. 5,048,802 which case was, in turn, filed as a continuation-in-part of application Ser. No. 07/373,672 filed Jun. 28, 1989, now abandoned, which case was, in turn, filed as a continuation-in-part of application Ser. No. 07/213,699 filed Jun. 30, 1988 (abandoned), which case was, in turn, filed as a continuation-in-part of application Ser. No. 06/907,473 filed Sep. 15, 1986 (issued Jul. 5, 1988 as U.S. Pat. No. 4,755,236), which, in turn, was filed as a division of application Ser. No. 06/732,400 filed May 9, 1985 (issued Sep. 16, 1986 as U.S. Pat. 4,611,791), which, in turn, was filed as a continuation-in-part of application Ser. No. 06/456,823 filed Jan. 10, 1983 (issued May 14, 1985 as U.S. Pat. No. 4,516,758). U.S. Pat. No. 4,516,758 will be referred to hereinafter as the "First Annealing Patent. All of the patents and applications that are identified above will be referred to collectively hereinafter as the "Annealing Cases." The disclosures of all of the Annealing Cases are incorporated herein by reference.

Reference also is made to two additional applications (and to patents that have issued therefrom) that are directly related to the First Annealing Patent, namely application Ser. No. 06/659,856 filed Oct. 11, 1984 (issued Mar. 31, 1987 as U.S. Pat. No. 4,653,171), which, in turn, was filed as a division of application Ser. No. 06/477,219 filed Mar. 21, 1983 (issued Mar. 3, 1987 as U.S. Pat. No. 4,647,022), which, in turn, was filed as a continuation-in-part of application Ser. No. 06/456,823 filed Jan. 10, 1983 (issued May 14, 1985 as U.S. Pat. No. 4,516,758). U.S. Pat. Nos. 4,653,171 and 4,516,758 relate to subject matter that includes features of furnace exit doors and methods for their construction and reconstruction; and, these two patents will be referred to hereinafter as the "Exit Door Patents," the disclosures of which are incorporated herein by reference.

BACKGROUND OF THE INVENTION

1. Field of the Invention

The present invention relates generally to an energy efficient closure system for minimizing loss of thermal energy through openings such as horizontally extending furnace entry openings and the like that are used to admit charges of material to treatment chambers, and is particularly well suited for use with entry openings of reheat furnaces through which slabs, billets or blooms of steel must pass so as to be admitted to furnace chambers wherein they are heated to proper temperatures to enable the steel members to be "worked" or otherwise formed into desired configurations. Heated slabs, for example, typically are processed through a rolling mill to form coils of steel stock.

One aspect of the preferred practice of the present invention relates to methods and means for minimizing convection and radiation heat loss through a furnace entry opening during passage of an elongate member therethrough as by utilizing a plurality of depending, inwardly curved, insulated door components that are arranged in a side-by-side array extending across the furnace opening, with each of the components being independently pivoted in response to being engaged by an underlying portion of an elongate member that is being fed through the furnace opening.

Another aspect of the preferred practice of the present invention relates to methods and means for enhancing the thermal efficiency of a side-by-side array of insulated, inwardly curved, pivotally mounted door components by utilizing a hanging curtain of flexible insulation that complements and cooperates with insulation that is carried by the door components. Still other aspects of the preferred practice of the invention reside in methods and means that are utilized to support the door components and the curtain, in the use of relatively narrow but relatively thickly insulated door components at selected locations along the door component array, and in features of the construction and mounting of the curved, insulated door components.

2. Prior Art

Large industrial apparatus for effecting thermal treatment of sizable charges of material that are admitted sequentially to and discharged sequentially from a thermal treatment chamber often are provided with inlet and outlet openings located on opposite sides of the treatment chamber. It is well known to provide such apparatus with insulated closures of various types for selectively opening and closing the inlet and outlet openings. Proposals of various types have been made to form insulated closures in component parts that are separately mounted for independent movement.

In conjunction with the art of steel making, it is well known to utilize what is referred to as a "reheat furnace" to sequentially heat steel slabs, billets or blooms to desired temperatures to enable these heated masses of steel to be "worked" or otherwise formed into predetermined configurations of steel stock. A reheat furnace typically has a treatment chamber that is capable of receiving a plurality of preformed slabs, billets or blooms of steel.[1] The slabs to be heated typically are fed through the treatment chamber relatively slowly in a direction of travel that extends from an inlet or entry opening located on one side of the treatment chamber to an outlet or exit opening located on an opposite side of the treatment chamber. Typically, each "slab" comprises an elongate quantity of steel that measures about twenty to twenty five feet in length, and has a generally rectangular cross section measuring about eight to eleven inches in thickness and about forty to about seventy inches in width.

While steel slabs tend to be relatively flat and straight, it is not unusual to encounter a slab that is twisted or bowed, or that has a non-uniform cross section. Thus, while inlet or entry openings to reheat furnaces usually do not need to be terribly tall to admit slabs therethrough, there are occasions when a twisted, bowed and/or non-uniform slab needs portions of the entryway opening to be taller than normally would be required by the median thickness of the material that forms the slab. This need presents a challenge to those who seek to conserve thermal energy by providing furnace entry doors that open only to the extent that is needed to accommodate an entering slab.

[1] For simplicity, the term "slabs" will be referred to during the remainder of this discussion. However, as those who are skilled in the art readily will understand, the present invention is not limited to use with steel slabs. Rather, the processing of "steel slabs" is discussed herein simply as being indicative of one example of a charge of material that can be fed through entry door structures that embody features of the present invention.

Although proposals have been made to form door structures of thermal treatment apparatus in sections that are arranged to open only to the extend needed to permit the passage therethrough of a charge of material to or from a treatment chamber, there remains a need for a door that is formed from a plurality of independently movable door components wherein each of the components opens only to the extend that is needed to permit passage of an engaging segment of material that is moving through the opening that is controlled by the door. Because steel slabs entering a reheat furnace tend to vary in length, thickness and in a variety of other ways; and, because slabs tend not to be perfectly centered with the opening of a reheat furnace when passing therethrough, there remains a need for a plural-segment entry door that will work well with a reheat furnace to open only if and to such extent as may be needed as slabs are fed in sequence through the entry opening of the furnace.

A further problem that is associated with providing components for use within the vicinity of the entry openings of reheat furnaces is that the intensity of the heat energy that tends to dissipate through such openings is of such a magnitude that special materials need to be utilized that resist thermal degradation; and, depending on the exposure that such materials receive, they may need to be provided with water cooling in order to assure service lives of reasonable length. Furthermore, inasmuch as structures that are positioned within the vicinity of the entryway opening of a reheat furnace sometimes are subjected to impacts by mis-aligned or mis-fed slabs, such structures need to have a capability to withstand such impacts if they are to provide suitable service lives.

The related Annealing Cases that are referenced above disclose the use of furnace components formed from nodular cast iron, and place emphasis on the use of nodular cast iron as a material that is particularly suitable for withstanding impacts within the high temperature environments of steel treating furnaces. Moreover, these cases disclose the use of water cooling in steel treatment furnace environments to enhance the longevity of furnace components. However, these cases do not address such needs as are addressed by the present invention including, for example, the longstanding need for improved methods and means to admit material to a treatment chamber through an entry opening while conserving the thermal energy of a treatment chamber environment.

The Exit Door Patents that are referenced above disclose the compressive packing and clamping of insulation material that is supported at least in part by nodular cast iron components, and wherein clamping of refractory insulation is, in some instances, effected by utilizing expanded metal structures. However, these cases also do not address such needs as are addressed herein, including, for example, the longstanding need for a novel and improved multi-segmented entry door that is well suited for use with steel reheat furnaces and the like.

SUMMARY OF THE INVENTION

The present invention addresses the foregoing and other needs and drawbacks and of the prior art by providing a novel and improved insulated furnace door system that utilizes a plurality of curved door components that open independently of each other and to only the extent required to admit successive charges of material to the treatment chamber of an apparatus such as a slab reheat furnace.

In accordance with the preferred practice of the present invention, an energy efficient closure system is provided to minimize the loss of thermal energy through an elongate, horizontally extending opening that is utilized to admit elongate articles, such as steel slabs, to the interior of a furnace, such as a reheat furnace. The system of the present invention utilizes a plurality of depending, individually mounted, independently pivoted, insulated, inwardly curved door components that are arranged in a side-by-side array, with each of the door components being biased by gravity so as to normally close its associated portion of the furnace opening. In preferred practice, the system of the present invention also utilizes a curtain of insulation that depends from a water-cooled support pipe that extends horizontally through an upper part of the furnace opening, with the curtain being formed by a plurality of depending, blanket-like bats of insulation that are arranged in a substantially contiguous, side-by-side array.

As a slab is moved toward and through the furnace opening, slab-engaged ones of the door components open in response to their being engaged by underlying segments of the slab. The extent to which each of the door components opens is limited to that which is required to admit its engaged slab segment. As the door components open, they engage adjacent portions of the curtain of insulation and inwardly flex such portions to the extent needed to permit passage of the slab through the furnace opening.

A feature of door components that embody the preferred practice hereof resides in the use that is made of curved backing members that are formed of nodular cast iron, a material that has been found to exhibit long-lived service in the high temperature environment of a steel treating furnace. Typically, the curved, nodular iron backing members provide years of service and enable the curved door segments to be periodically rebuilt as may be needed after many hours of service, during which time the insulation that is carried by the door components likely will have deteriorated or been damaged due to exposure to high heat and periodic impact as the door components pivot open and closed and are engaged by slabs being moved through the furnace entry opening.

A further feature of door components that embody the preferred practice hereof resides in the use of a novel form of mounting bracket to individually pivotally mount each of the curved door components on an elongate support. Each of the mounting brackets preferably carries threaded fasteners that are tightened into engagement with the elongate support to mount the door components on the support for pivotal movement relative to their mounting brackets. The fasteners may be loosened and the brackets removed from the elongate support if selected ones of the door components need to be quickly replaced during use of the reheat furnace, whereby the insulated door system can be kept operating properly for long periods of time without necessitating that the reheat furnace be shut down so that the insulated door system can be serviced and/or re placed with a new or rebuilt set of components.

Still another feature of the preferred practice of the present invention resides in the favorable geometry that the curved door components present for being engaged by portions of slabs that are to be admitted to the reheat furnace. The "favorable geometry" that is employed results not only from configuring the curved door components in a particular manner, but also from carefully positioning the curved door components as by suitably positioning the substantially horizontal axis about which the curved door components pivot in moving between their open and closed positions.

A first of the aspects of the "favorable geometry" that is employed in preferred practice involves selecting the curvature of the curved backing members that form the rigid structure of the curved door components. In preferred practice, the backing members are not only "inwardly curved" but also are "arcuately inwardly curved" (i.e., the curve that each of the backing members follows is an arc that is a segment of a circle that has a predetermined radius). The radius that determines the curvature of each of the arcuately curved backing members preferably is selected to be within the range of "greater than one-half of the height" to "less than the height" of the entry opening. Thus, if an entry opening is thirty inches in height, the radius (or radii) that are utilized in backing member components preferable is/are greater than fifteen inches but less than thirty inches.

A second of the aspects of the "favorable geometry" that is employed in preferred practice involves selecting the length of the arcuate segment that is formed by the component(s) that forms each of the curved backing members. In preferred practice, the length is selected so that, when viewed from the side, each of the curved door components is seen to curve through an arc of slightly more than 90 degrees. In most preferred practice, the backing member has a length that permits it to arc through a range of about 95 degrees to about 115 degrees.

A third of the aspects of the "favorable geometry" that is employed in preferred practice involves the positioning of the horizontal axis about which each of the curved door components pivots in moving between its open and closed positions. In preferred practice, the pivot axis is positioned near the top of the entry opening but at a location spaced forwardly therefrom so as to permit the curved door components to comply with the following further characteristics of "favorable geometry" that preferably exist when the door components are closed, namely: 1) the upper end regions of the curved door components have portions thereof that extend relatively vertically at a location that is relatively near to the top of the furnace opening but spaced outwardly therefrom; and, 2) the lower end regions of the curved door components extend relatively horizontally at locations wherein they make engagement with such furnace structure as defines the bottom of the entry opening.

By the aforedescribed arrangement of geometry, the curved backing members (i.e., the curved door component portions that initially are engaged by a slab that passes through the associated furnace entry opening) presents a very favorable angle of inclination to an entering slab. Typically, the angle of inclination of the component portion that initially is engaged by an entering slab (i.e., the angle of an imaginary line that is tangent to the curved door component at the point thereon that initially is engaged by the slab) is inclined relative to the substantially horizontal path of movement of the slab by about 35 to about 55 degrees (with about 45 degrees being considered to be "optimal") so that the initial engagement of the slab with a door component will, without hesitation or "jamming," cause the engaged component to promptly begin to pivot and be lifted by the slab to provide slab access to a needed portion of the composite entry opening that is precisely tall enough to admit the engaged slab segment. "Jamming" of entering slabs and door components is almost entirely eliminated by virtue of this type of arrangement of "favorable geometry."

While the "favorable geometry" characteristics that are set out above are believed to properly describe such curved door component configurations as fall within the scope of the preferred practice of the present invention, it will be understood by those who are skilled in the art that the aforedescribed characteristics are not as limiting in their definition of the configuration of door components as might initially appear to be the case. For example, in preferred practice, the "backing member" often is not formed as a single component; nor does an appropriately configured door component necessarily follow a single radius of curvature.

Rather, in preferred practice, the backing member often is formed from a plurality of components that include, as a minimum, 1) a relatively uniform radius lower member that covers (when closed) a majority of its associated furnace opening segment, and 2) a relatively uniform radius upper member that extends from an upper end region of the lower member to within the vicinity of the top of the associated furnace opening segment. While the upper and lower components can be formed so as to feature identical radii of curvature, and while the juncture between the upper and lower components can be arranged such that the radii of curvature of the upper and lower components define a continuous segment of a single circle, there are applications wherein it is desirable to utilize upper and lower components having differing radii, and/or to configure the juncture between the upper and lower components such that the arcs defined by their radii join at a slight angle rather than to provide smooth extensions of each other. Later in this document, the design of other than single-component and/or single-radius curved door components will be addressed in greater detail.

In accordance with a further feature of the preferred practice of the present invention, door components that are located near opposite ends of the furnace opening preferably are relatively narrow so that, unless an entering slab is unusually long, one or more of the end components will not be opened by the slab. Moreover, the end components preferably carry especially thick insulation to help minimize heat loss from between adjacent "opened" and "non-opened" door components. These narrow, thickly insulated door components also can be provided at other selected locations along the length of the furnace opening if the character of material being admitted to the furnace is such that, at the selected locations, it is likely that one or more of the door components often may remain closed while adjacent components frequently will need to open.

BRIEF DESCRIPTION OF THE DRAWINGS

These and other features, and a fuller under standing of the present invention may be had by referring to the following description and claims, taken in conjunction with the accompanying drawings, wherein:

FIG. 6 is a sectional view, on an enlarged scale, of one form of curved door component that embodies features of the preferred practice of the present invention, as seen generally from a line 6—6 in FIG. 2;

FIG. 7 is a perspective view of the curved door component of FIG. 6, with the view showing principally inner features thereof;

FIG. 8 is a perspective view that is similar to FIG. 7 but with portions of the door component being broken away to permit underlying details of construction to be viewed;

DESCRIPTION OF THE PREFERRED EMBODIMENT

Figure 1:
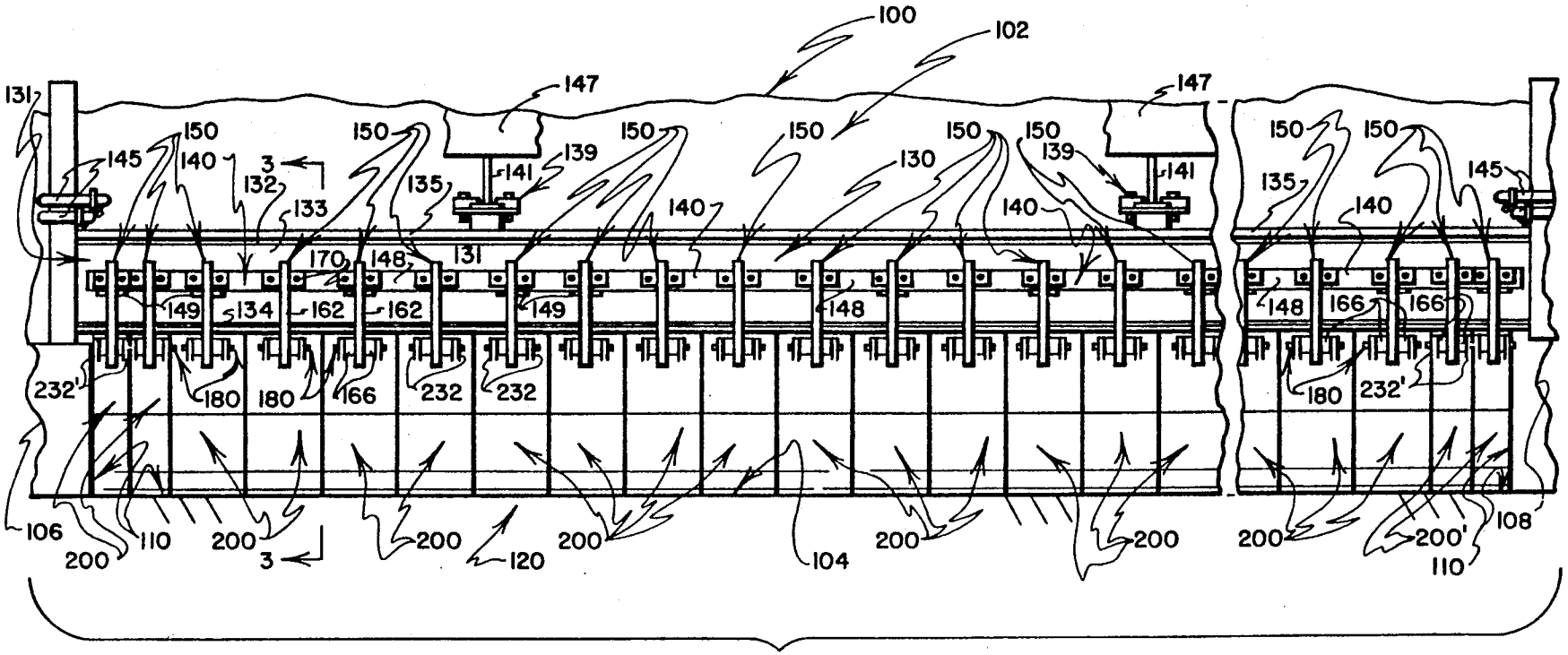
FIG. 1 is a foreshortened front side elevational view of portions of the entry side of a reheat furnace of the type that is used to heat steel slabs, with the view showing components of an insulated furnace door system that embodies the preferred practice of the present invention.
Figure 2:
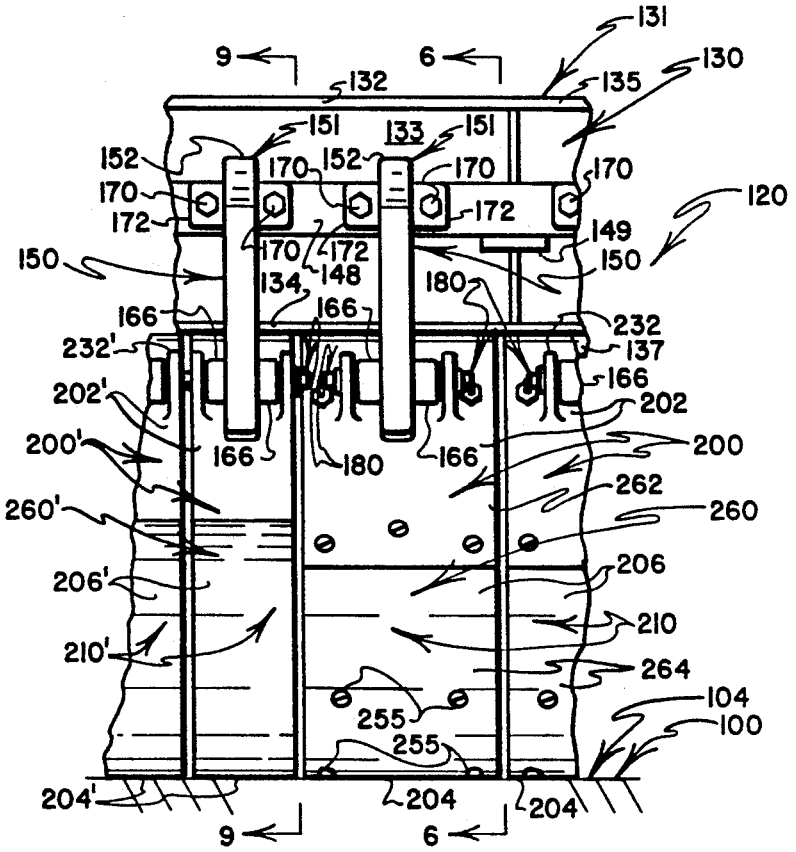
FIG. 2 is an enlargement of a portion of the side elevational view of FIG. 1.
Figure 3:
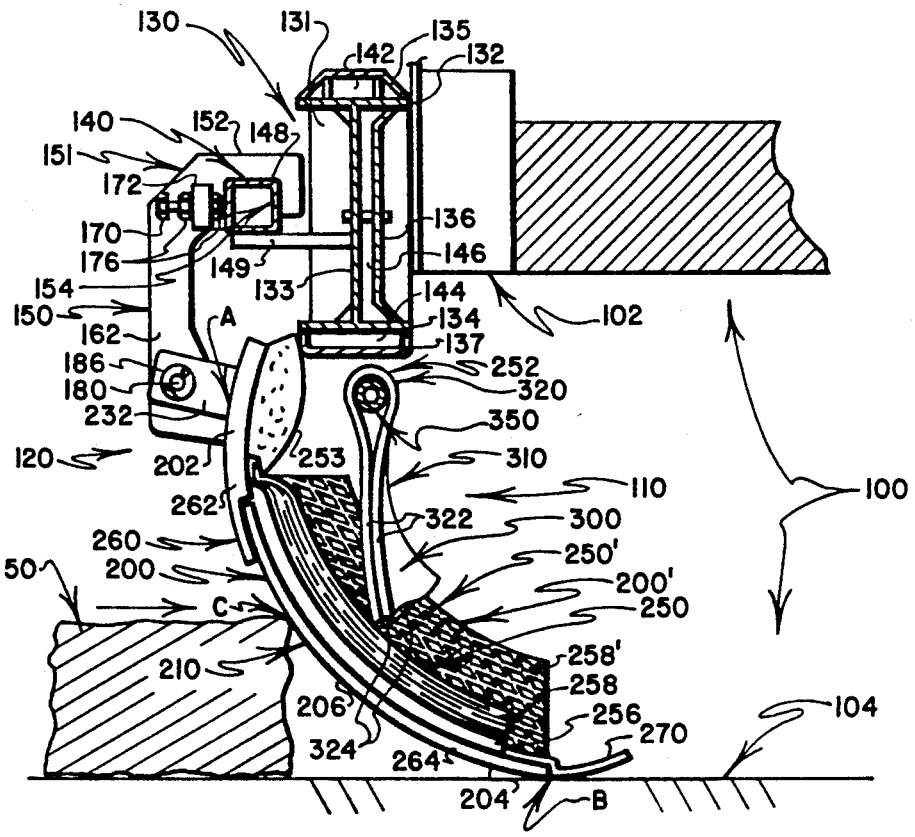
FIG. 3 is a sectional view, on an enlarged scale, as seen from a plane indicated by a line 3—3 in FIG. 1, and showing leading edge portions of a slab of steel moving along a path of travel toward curved door components of the insulated furnace door system, but with the door components still in their closed positions.

Referring to FIG. 1, a portion of the exterior face of the entry area of a slab reheat furnace is indicated generally by the numeral 100. Referring to FIGS. 1 and 3, the furnace 100 has upper and lower structure 102, 104, respectively, and left and right structure 106, 108, respectively that cooperate to define a substantially horizontally extending entry opening 110. Typically, the entry opening 110 is about two to three feet in height, and is about thirty to forty feet in length; however, as will be readily apparent to those who are skilled in the art, principles of the present invention can be utilized with entry openings for apparatus other than steel treating furnaces, and can be used with substantially any size of generally horizontally extending entry opening.

In accordance with the preferred practice of the present invention, and representing the best mode known to the inventor hereof for practicing the present invention, the accompanying drawings depict features of an insulated furnace door system that is indicated generally by the numeral 120. Referring to FIGS. 1-3, 13 and 14, the system 120 includes a support structure 130 that extends substantially horizontally along the top of the furnace entry opening 110 at a location just outside the entry opening 110.

The system 120 also includes a plurality of mounting bracket assemblies 150 that clampingly engage an elongate tubular support component 140 of the support structure 130 at spaced locations along the furnace opening 110. Also, the system 120 includes a plurality of curved, insulated door components 200, 200′ that are arranged in a closely spaced relationship that permits each of the door components 200, 200′ to move relative to adjacent ones of the door components 200, 200′. Moreover, the closely spaced relationship of adjacent ones of the door components 200, 200′ assures that the array of components 200, 200′ extends substantially contiguously to bridge and close the full length of the furnace opening 110. Upper end regions of the curved door components 200, 200′ are pivotally supported by the bracket assemblies 150 for movement about an axis that is indicated by the numeral 160 in FIGS. 7, 8 and 10-14.

Figure 13:
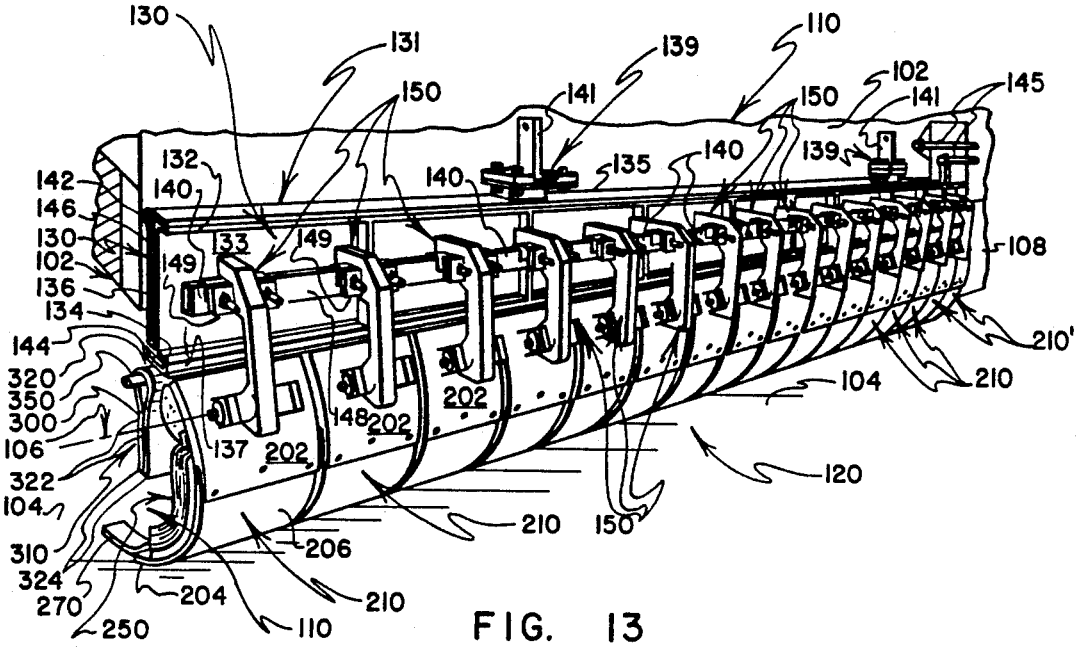
FIG. 13 is a perspective view showing selected portions of the insulated furnace door system of FIG. 1, with the view showing principally outer features thereof; and, FIG. 14 is a perspective view showing selected portions of the insulated furnace door system of FIG. 1, with the view showing principally inner features thereof.
Figure 14:
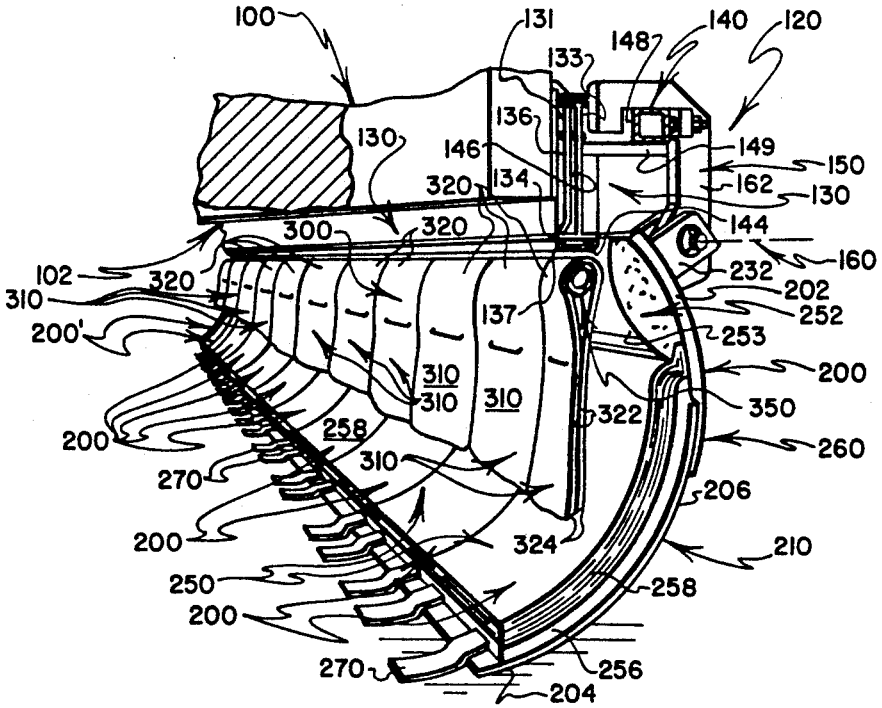

Referring to FIGS. 3, 13 and 14, the system 120 further includes a curtain of relatively flexible refractory insulation that is indicated generally by the numeral 300. The curtain 300 depends from the support structure 130 at a location on the inner side of the array of door components 200, 200′. The curtain 300 is defined by a plurality of blanket-like bats 310 of insulation that are arranged to depend across more than half of the height of the furnace opening 110 so as to extend from immediately adjacent the bottom of the support structure 130 toward positions of engagement with the insulated inner surfaces of the curved door components 200, 200′.

The bats 310 of insulation extend in side-by-side abutting engagement so as to extend substantially continuously, contiguously and without significant interruption across substantially the full length of the furnace entry opening 110. Each of the bats 310 is formed from an elongate, blanket-like length of flexible refractory fiber insulation material that is folded to form an inverted U-shaped configuration, with a U-shaped central region 320 interconnecting a pair of overlying reaches 322 of insulation that have adjacently positioned ends 324 that cooperate to define bottom portions of the curtain 300. The overlying reaches 322 are adhered, bonded, connected or otherwise suitably fastened together so that the U-shaped configurations of the bats 310 are properly maintained.

Each of the U-shaped central regions 320 is wrapped around a supporting pipe structure 350 that is connected to and is supported by the support structure 130. To enhance longevity and service life, cooling water is circulated through cooling water "jackets" or "passages" that are defined by the support structure 130; and, cooling water is circulated through the supporting pipe structure 350—as will be discussed in greater detail shortly.

Referring to FIGS. 2–11, 13 and 14, the door components 200, 200' curve inwardly with respect to the furnace opening 110 as they depend from upper end regions 202, 202' thereof located near their junctures with the mounting bracket assemblies 150 which pivotally support the door components for movement about the axis 160. Lower end regions 204, 204' of the door components 200, 200' curve inwardly into the furnace opening 110 so as to over lie portions of the "floor" of the opening 110 which is defined by the lower furnace structure 104. Central regions 206, 206' of the door segments 200, 200' connect the upper and lower end regions 202, 202' and 204, 204' by relatively smoothly configured curves, the character of which will be discussed in greater detail later herein. By this arrangement and mounting of the door components 200, 200', the door components 200, 200' are caused to be biased by gravity toward "closed" positions of engagement with the lower furnace structure 104, which closed positions are depicted in FIGS. 1–3, 13 and 14. When not being held open by virtue of being engaged by a portion of a steel slab that is passing through the furnace opening 110, the door components 200, 200' are biased by gravity toward the aforedescribed "closed" positions.

Figure 4:
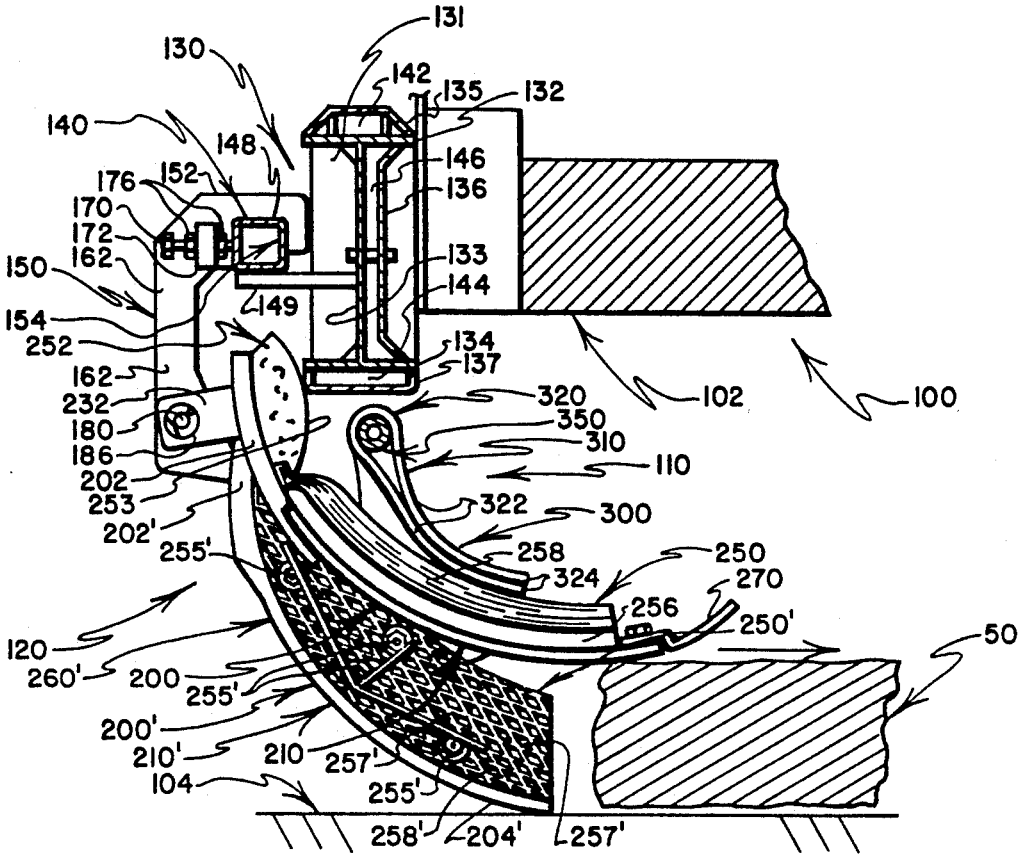
FIG. 4 is a sectional view that is similar to FIG. 3 but which shows at least one of the curved door components pivoted to an open position while at least one other of the curved door components is still in its closed position, and with only trailing edge portions of the slab being shown engaging the open component(s)
Figure 5:
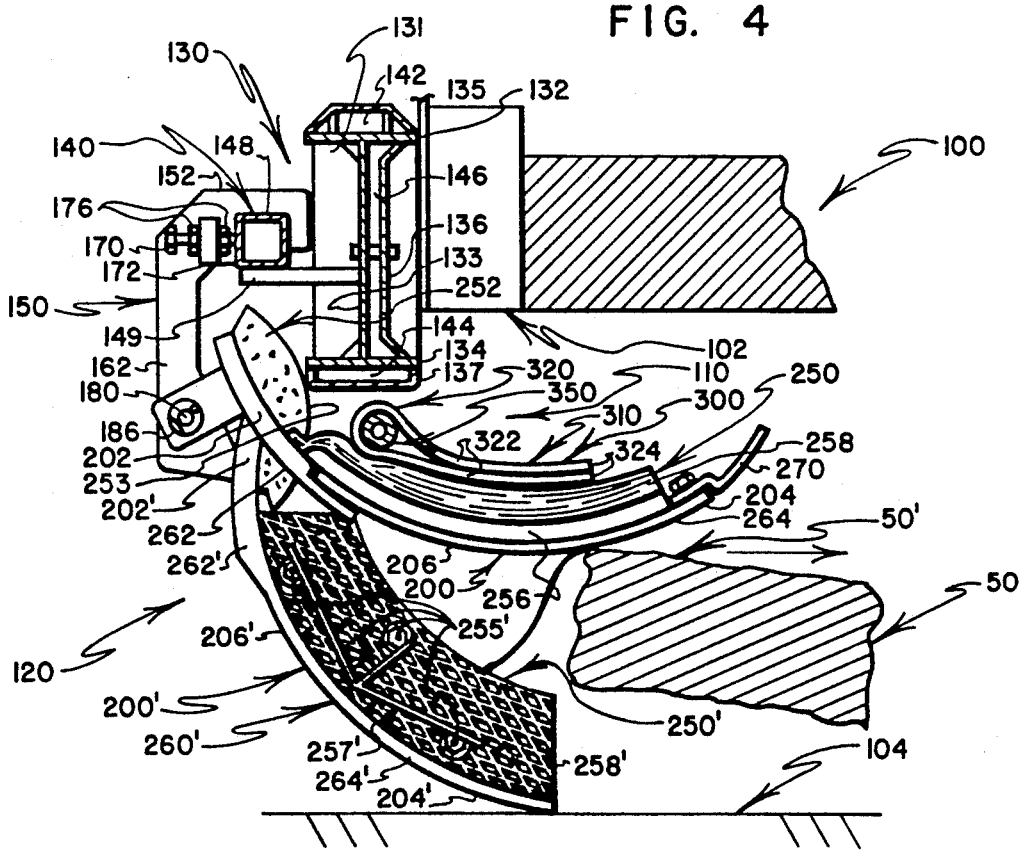
FIG. 5 is a sectional view that is similar to FIG. 4 but which shows at least one of the curved door components pivoted open to an unusual extent to permit passage therebeneath of trailing edge portions of a bowed or twisted slab.

As an elongate slab of steel, indicated generally by the numeral 50 in FIGS. 3–5, is moved through the furnace entry opening 110, the slab 50 typically engages many of the inwardly curved, outwardly facing surfaces 210, 210' that are defined by the components 200, 200', respectively. Referring to FIG. 4, the engagement that is made by a slab 50 with the surfaces 210 and/or 210' as the slab 50 moves through the furnace opening 110 causes engaged ones of the door components 200 and/or 200' to pivot about the axis 160 (in a counterclockwise direction as viewed in FIGS. 4 and 5) to open and permit passage of the slab 50 beneath engaged ones of the components 200 and/or 200'. Referring to FIGS. 4 and 5, engaged ones of the door components 200 and/or 200' are caused to be pivoted open to differing degrees depending on the thickness and vertical positioning of such segments of the slab as come into engagement with the components 200, 200'. In FIG. 5, for example, an engaged portion 50' of an upwardly bowed slab is shown causing an engaged door component 200 to be pivoted open to an unusual degree.

As engaged ones of the curved door components 200 and/or 200' are caused to be pivoted open to differing degrees by slabs 50 passing thereunder for entry through the furnace opening 110, adjacent bats 310 of the insulation curtain 300 are likewise caused to be engaged to differing degrees by insulated inner surfaces of the door components 200, 200'. The bats 310 are caused to flex inwardly and to swing about the supporting pipe structure 350 so that, as needed, portions of the bats 310 move in concert with engaged ones of the door components 200 and/or 200'. However, because the vertically extending lines of juncture between adjacent ones of the bats 310 are deliberately mis-aligned with the thin, vertically extending spaces that are provided between adjacent ones of the door components 200, 200', the curtain 300 serves to cooperate quite effectively with the door components 200, 200' to block the transfer through the furnace opening 110 of much of the thermal energy that otherwise would be lost through the opening 110. Moreover, the presence of the curtain 300 helps to permit a slightly-higher-than-ambient pressure to be maintained, if so desired, within the treatment chamber of the furnace 100.

Turning now to a more detailed description of features of the various components that comprise the insulated furnace door system 120, and referring initially to FIGS. 1, 3, 13 and 14, the support structure 130 includes an I-beam 131 that has top and bottom flanges 132, 134 that are centrally interconnected by an upstanding web 133. Top and bottom cap structures 135, 137 are welded atop the top flange 132 and beneath the bottom flange 134, respectively; and, an inwardly facing cap structure 136 is welded to interior surfaces of the top and bottom flanges so as to extend between the top and bottom flanges 132, 134 at a location that is spaced inwardly from the central web 133. The top, bottom and inwardly-facing cap structures 135, 137 and 136 cooperate with the top and bottom flanges 132, 134 and with the web 133 to define a plurality of top, bottom and centrally extending "water jackets" or "cooling passages" 142, 144, 146 that extend along substantially the full length of the I-beam 131 to maintain proper operating temperatures along the support structure 130.

The cooling passages 142, 144, 146 are suitably connected to conduits for circulating cooling water thereto and therefrom, with typical ones of such conduits being indicated by the numeral 145 in FIGS. 1 and 13. By this arrangement, an adequate flow of cooling water to assure that the support structure 130 (and particularly lower portions thereof that are exposed to the heated environment of the furnace 100) are kept sufficiently cool to assure a lengthy service life. Likewise, the pipe structure 350 that extends beneath the bottom flange 134 also is preferably supplied with a flow of cooling water therethrough.

The preferred manner for supplying a proper flow of cooling water through the pipe structure 350 is to form the pipe structure 350 in a plurality of aligned segments (not shown) that each have opposed end regions thereof that communicate with portions of the lower water cooling passage 144 that extends along the bottom flange 134 of the beam 131. To assure that proper flows of cooling water are provided to various portions of the passages 142, 144, 146 as well as to the pipe structure 350, suitable holes (not shown) may be drilled or otherwise formed through the top and bottom flanges 132, 134 of the beam 131; and, if desired, baffles (not shown) or other forms of flow ducting and control devices may be provided—as is conventional and readily will be understood by those who are skilled in the art. Inasmuch as the supply of adequate flows of cooling water to the described passages 142, 144, 146 and to the pipe 350 involves simply the conventional application of known techniques of plumbing and fluid flow management, no more detailed discussion of the supply of cooling water needs to be presented here.

Referring to FIGS. 1 and 13, the support structure 130 is provided at spaced locations along its uppermost surface with bracket support assemblies 139 or the like that typically include upwardly extending support members 141 for connection to suitable, conventionally configured furnace door supports, portions of which are indicated generally in FIG. 1 by the numeral 147. Depending on the type of furnace on which the door system 120 is installed, the character of the conventional furnace door support structure 147 to which the bracket assemblies 139 connect may vary quite widely, as readily will be understood by those who are skilled in the art.

Referring to FIGS. 3–6, 9 and 14, the tubular support member 140 takes the form of one or more lengths of square tubing 148 (typically three by three inch square tubing having a standard wall thickness of about five sixteenths of an inch) that is/are connected by welded supports 149 to the front side of the web 133 of the I-beam 131. By this arrangement, the tubular support member 140 is rigidly supported at a location that is spaced outwardly (i.e, forwardly) from the web 133 of the I-beam 131.

Figure 12:
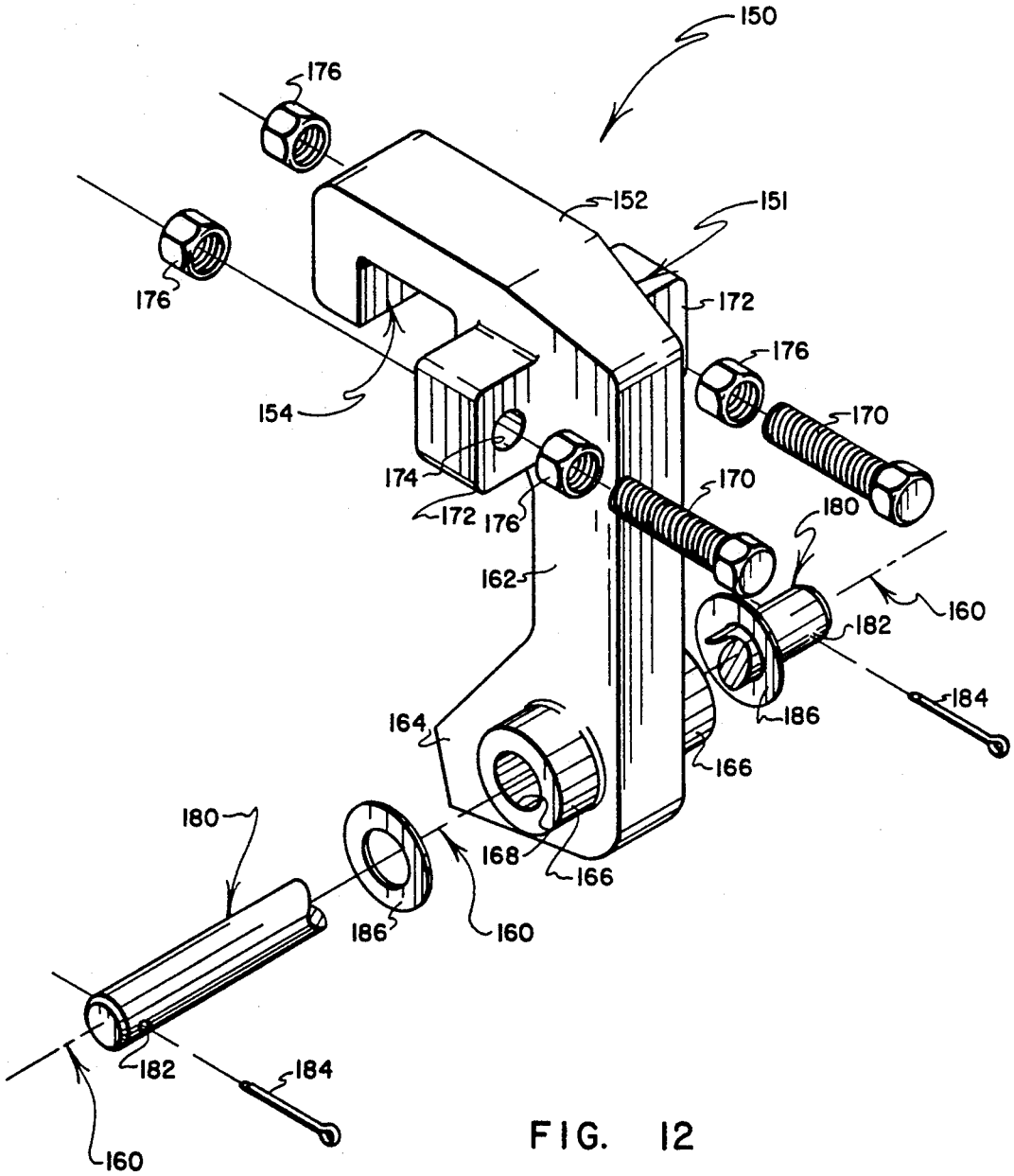
FIG. 12 is an exploded perspective view, on an enlarged scale, of a mounting bracket and associated hardware that preferably is employed in mounting each of the curved door components for independent pivotal movement.

Referring principally to FIG. 12, the mounting bracket assembly 150 includes an inverted L-shaped mounting bracket 151 that preferably is formed as a casting of nodular iron that has a forwardly/rearwardly extending top leg 152 that has a rectangular notch 154 formed therein; and a front, vertically extending leg 162 that has an enlarged lower end formation 164. The notch 154 is configured to receive upper portions of the tubular support member 140. A pair of aligned, opposed, generally cylindrical projections 166 are provided on opposite sides of the vertically extending leg 162 within the vicinity of the enlarged lower end formation 164. The projections 166 extend concentrically about the pivot axis 160 and about a hole 168 that extends along the axis 160 through the vertical leg 162 and opens through opposed faces of the projections 166.

Near the juncture of the legs 152, 162 of the mounting bracket 151, a pair of oppositely projecting fastener mounting tabs 172 are provided that have holes 174 extending therethrough (only one of which is visible in FIG. 12) that parallel the forwardly/rearwardly extending leg 152. Threaded bolts 170 extend through the holes 174 and are secured in selected positions by means of pairs of locknuts 176 that are threaded onto the bolts 170 at locations on opposite sides of the mounting tabs 72. By positioning the notch 154 to receive upper portions of the square tubular member 140, by tightening the bolts 170 into secure engagement with the square tubular member 140, and by locking the nuts 176 in place, the mounting brackets 151 are securely, rigidly and individually connected to the square tubular member 140 in a way that permits prompt removal of one or more of the mounting brackets 151 therefrom so that one or more associated ones of the curved door components 200, 200' that are connected to the removed mounting bracket(s) can be quickly removed and replaced during operation of the furnace 100.

The connection of each of the mounting brackets 151 to a separate one of the curved door components 200, 200' is effected by utilizing a shaft-like mounting pin 180 that is insertable through the hole 168 and through a pair of aligned holes 234 that are provided in a pair of spaced mounting arms 232 that are provided on the upper end regions 202, 202' of each of the door components 200, 200'. Opposite end regions of each of the pins 180 have holes 182 extending diametrically therethrough for receiving cotter pins 184. Flat washers 186 are carried on opposite end regions of the pin 180 at locations adjacent the cotter pins 184, with such reaches of the pin 180 as extend between each of the washers and the associated cylindrical projections 166 being configured to receive the mounting arms 232 that are carried on the door components 200, 200', respectively.

The numerals 200, 200' designate two different types of curved, insulated door components, both of which incorporate features of the preferred practice of the present invention. Referring to FIGS. 6–8, the components 200 are relatively wide and carry a relatively thin complement of insulation 250, the nature of which will be described shortly. The components 200' are relatively narrow and carry a relatively thick complement of clamped layers of insulation 250', the nature of which will be described shortly.

The relatively wide, relatively thinly insulated components 200 that are depicted in FIGS. 6–8 typically comprise the majority of the curved door components that are utilized in the construction of the insulated furnace door system 120. In a typical installation, the components 200 comprise all but a limited number of "end components" that are located near opposite ends of the furnace opening 110. The door components 200 typically are used to form an insulated furnace door unless there is a reason to substitute, at one or more given locations along the length of a particular door location, one or more of the components 200'.

The relatively narrow, relatively thickly insulated components 200' are useful at locations along a door opening wherein there is a relatively high likelihood that, as materials are admitted through the door opening, end regions of the materials will leave one or more of the curved door components closed while an adjacent component is being opened due to being engaged by entering material. In situations wherein one of two adjacent curved door components is being opened while the other of the two adjacent components remains closed, the relatively thick insulation that is carried by the components 200' will help to prevent the unwanted loss of thermal energy from between adjacent opened and non-opened components. Moreover, the narrow character of the components 200' helps to assure that an "effective entry opening" of minimal length is "opened" for admission of an entering slab of steel or the like, for, if a slab end has only an inch of material that underlies a curved door component and thereby forces the entire door component to open, less thermal energy obviously will be lost if the opened component is relatively narrow so as to minimize the unnecessary opening area that extends beyond the end of the entering slab.

Referring to FIG. 4, the unopened end component 200' that is depicted as residing behind an opened component 200 illustrates that the thick insulation of the (end component 200' helps to block the escape of thermal energy from between the unopened end component 200' and the opened component 200. Also shown in this view is an example of the flexing of an end bat 310 of insulation that forms a part of the curtain 300—whereby it is seen that the presence of the curtain 300 also assists in preventing the loss of thermal energy between opened and unopened door components that reside adjacent each other.

Inasmuch as the likelihood for adjacent door components to not be opened tends to occur more regularly near the ends of the furnace opening 110 than at other locations along the length of the furnace opening 110, the narrow, thickly insulated components 200' have come to be referred to as "end components." However, as those who are skilled in the art readily will appreciate, there are many applications wherein the use of one or more narrow, thickly insulated components 200' would serve a useful purpose at locations other than at opposite ends of a furnace entry opening. For example, if instead of admitting relatively long slabs that are nearly the length of a furnace opening, slabs having less than half the length of the furnace opening are being admitted in pairs (i.e, two of these short slabs are being admitted concurrently, with one being admitted near one end region of the furnace, and with the other being admitted near the other end region of the furnace, it would make sense to use an array of narrow, thickly insulated components toward the center of the furnace opening wherein there will almost always be a significant space between left and right slabs that are being admitted concurrently through the furnace opening.

Because the components 200, 200' have many corresponding features that involve functionally equivalence if not structural identity, corresponding features of the curved door components 200, 200' are indicated in the drawings hereof by numerals that are identical except that the numerals that are used with the door components 200' carry a "prime" mark.

Referring to FIGS. 6–8 and 9–11, the curved door components 200, 200' have rigid, curved backing structures 260, 260'. The backing structures 260, 260' preferably are formed in either as a one-piece casting of nodular iron, or as an assembly of two pieces that are formed from nodular cast iron. Regardless of whether the backing structures 260, 260' are formed as one-piece units or as plural-part assemblies, the structures 260, 260' have what will be referred to as upper radius portions 262, 262' and lower radius portions 264, 264'. In the door component embodiment of FIGS. 6–8, the backing structure 260 has its upper and lower radius portions 262, 264 formed as separate castings of nodular iron that are bolted together by fasteners 263 (or otherwise suitably connected). In the door component embodiment of FIGS. 8–11, the backing structure 260' is formed as a single nodular iron casting.

In accordance with the preferred practice of the present invention, the upper radius portions 262, 262' may define a radius that is precisely the same as or somewhat different from the radius of the lower radius portions 264, 264'. However, in accordance with preferred practice, the radius or radii that are selected for a particular door component 200, 200' should fall within a range that is defined by being "at least slightly greater than half of the height of the entry opening" that is to be closed by an array of such door components, and by being "at least slightly less than the full height of the entry opening." Thus, if the furnace opening to be closed has a height of 30 inches, the radius (or radii) of curvature that is selected for the members 262, 262', 264, 264' preferably is greater than 15 inches but less than 30 inches—with a middle-of-the-range radius of about 20 to 25 inches being considered to be most preferable.

Because outer surfaces 266, 266' of the curved backing structures 260, 260' are presented to entering slabs of steel and the like to be directly engaged in a way that causes the door components 200, 200' to pivot and lift so as to effect movement to such open positions as are illustrated in FIGS. 4 and 5 (wherein a door component 200 is depicted as being held open by virtue of its engagement with portions of an underlying slab 50), the "geometry" that is associated with the inward inclination and other features of orientation of the curved backing structures 260, 260' is of some importance if optimum performance and reliability are to be provided.

Stated in another way, a feature of the preferred practice of the present invention resides in the "favorable geometry" that properly arranged and configured curved door components present for being engaged by portions of slabs that are to be admitted to the reheat furnace 100. The "favorable geometry" that is employed results not only from configuring the curved door components 200, 200' in a particular manner, but also from carefully positioning the curved door components 200, 200' as by suitably positioning the substantially horizontal axis 160 about which the curved door components 200, 200' pivot in moving between their open and closed positions.

A first of the aspects of the "favorable geometry" that is employed in preferred practice involves selecting the curvature of the curved backing structures 260, 260' such that the upper and lower radius portions 262, 262' and 264, 264' fall within the aforedescribed range of "greater than one-half of the height" to "less than the height" of the entry opening 110.

A second of the aspects of the "favorable geometry" that is employed in preferred practice involves selecting the length of the arcuate segment that is formed by the component or components that forms or cooperate to form the curved backing structures 260, 260' In preferred practice, the length is selected so that, when viewed from the side, each of the curved backing structures 260, 260' is seen to curve through an arc of slightly more than 90 degrees. In most preferred practice, each of the backing structures 260, 260' has a length that permits it to arc through a range of about 95 degrees to about 115 degrees.

A third of the aspects of the "favorable geometry" that is employed in preferred practice involves the positioning of the horizontal axis 160 about which each of the curved door components 200, 200' pivots in moving between its open and closed positions. In preferred practice, the pivot axis 160 is positioned (as by suitably configuring the mounting brackets 151) near the top of the entry opening 110 but at a location spaced forwardly therefrom so as to permit the curved door components 200, 200' to comply with the following further characteristics of "favorable geometry" that preferably exist when the door components 200, 200' are closed, namely: 1) the upper radius portions 262, 262' of the curved backing structures 260, 260' have components thereof that extend relatively vertically at a location that is relatively near to the top of the furnace opening 110 but is spaced outwardly therefrom (for example in the area indicated by the arrow "A" in FIG. 3); and , 2) the lower radius portions 264, 264' of the curved backing structures extend substantially horizontally at locations wherein they make engagement with such furnace structure as defines the bottom of the entry opening (for example in the area indicated by the arrow "B" in FIG. 3).

By the aforedescribed arrangement of geometry, the portions of the curved backing structures that initially are engaged by a slab 50 that passes through the furnace opening 110 (for example in the area indicated by the arrow "C" in FIG. 3) presents a very favorable angle of inclination to an entering slab. Typically, the angle of inclination of the component portion that initially is engaged by an entering slab (i.e., the angle of an imaginary line that is tangent to the curved backing structure 260, 260' at the point thereon that initially is engaged by the slab 50) is inclined relative to the substantially horizontal path of movement of the slab by about 35 to about 55 degrees (with about 45 degrees being considered to be "optimal") so that the initial engagement of the slab with a door component 200 and/or 200' will, without hesitation or "jamming," cause the engaged component 200 and/or 200' to promptly begin to pivot and be lifted by the slab 50 to provide slab access to a needed portion of the composite entry opening that is precisely tall enough to admit the engaged slab segment. "Jamming" of entering slabs and door components is almost entirely eliminated by virtue of this type of arrangement of "favorable geometry."

While the upper and lower radius portions of the door components 200, 200' preferably have radii that meet the standards of preferred practice that are set out above, those skilled in the art readily will understand that, inasmuch as features of the present invention have relatively wide applicability and can be used with entry openings that are employed in a variety of types of apparatus, one simple way in which a good bit of needed latitude can be given to designers while still effecting the desired compliance is to vary the angle of inclination at which the upper and lower radius portions of a particular door component 200, 200' join. While the juncture between the upper and lower radius portions of the door components 200, 200' can be arranged such that the upper and lower radii of curvature define a continuous segment of a single circle, there are applications wherein it is desirable to utilize upper and lower radii that differ and/or that join together at a gentle angle of inclination that does not cause the resulting door component configuration to differ to any significant extent from the guidelines that have been set out above. For example, in each of the components 200, 200' that are depicted in the drawings hereof, slightly different upper and lower radii are utilized (each of which falls within the prescribed range); and, the juncture of the upper and lower radii features a slight angle of inclination rather than a perfectly smooth continuation of the same complex curve.

Returning now to a description of the make-up of the curved door components 200, 200' that are depicted, respectively, in FIGS. 6–8 and FIGS. 9–11, the support arms 232 connect with upper end portions of the curved backing structures 260, 260'; and, the aligned holes 234 that are formed through the support arms 232 to receive the mounting pins 180 extend outwardly (i.e., forwardly) from the furnace opening 110 to establish the above-described characteristic type of connection that is pivotal about the axis 160.

Referring to FIGS. 6–8, lower end regions of the curved backing structures 260 that form the relatively wide components 200 can be extended, if desired, at a plurality of locations as by securing foot-like members 270 thereto. Such "extensions" of the curvature of the backing structures 260 may be desirable in steel furnaces of the "walking beam" type that sometimes permit a slab that has passed through a portion of the furnace door 120 to "kickback" as by moving slightly in reverse at times while the slab is intended to be fed into the furnace. It has been found that extension tabs 270 that function to increase the effective length of the arc through which the curved backing structure perform quite nicely to assure that, during slight backward movements of entering slabs, the components of the door structure 120 do not become damaged.

Referring principally to FIGS. 7–8 and 10–11, the complements of insulation 250, 250' that are carried by the door components 200, 200' have both similarities and differences. With respect to similarities, the components 200, 200' carry relatively hard, curved-face bodies of insulation 252, 252' that are located near the upper end regions of the backing structures 260, 260' and that define inwardly-facing surfaces 253, 253' that are segments of a cylinder that is concentric about the axis 160. Because the surfaces 253, 253' are positioned to extend into closely spaced relationship with the bottom cap 137 of the support structure 130, the curved-face bodies 252, 252' cooperate quite effectively with the water-cooled bottom cap 137 to provide a thermally efficient juncture between these relatively movable components.

In preferred practice, the curved face bodies 252, 252' are "cast" refractory structures that are provided with one or more recessed fastener receiving openings 254, 254' that enable conventional threaded fasteners 255, 255' to be installed in aligned holes that are formed through the bodies 252, 252' and through adjacent portions of the curved backing structures 260, 260' Preferably, after the fasteners 255, 255' that are used to hold the curved face bodies 252, 252' are tightened in place, the recessed holes 254, 254' that face inwardly are filled with refractory cement or other suitable substance (see Differences between the complements of insulation 250, 250' that are utilized to line inner surface portions of the curved backing structures 260, 260' necessitate that the remainder of the descriptions of the complements of insulation 250, 250' be presented separately.

Referring to FIGS. 6–8, a board-like sheet of relatively rigid but somewhat pliable refractory insulation 256 is conformed to the inner curvature of the backing structure 260 and is fastened in place by conventional threaded fasteners 255 that extend through one or more pieces of expanded metal 257. Overlying the insulation board 256 is a blanket-like bat of fiber-type refractory insulation 258 that is bonded to the insulation board 256 by high temperature adhesive, and that has its upper end region (together with the upper end region of the insulation board 256) clamped by an overlying lip of the curved body 252.

Figure 9:
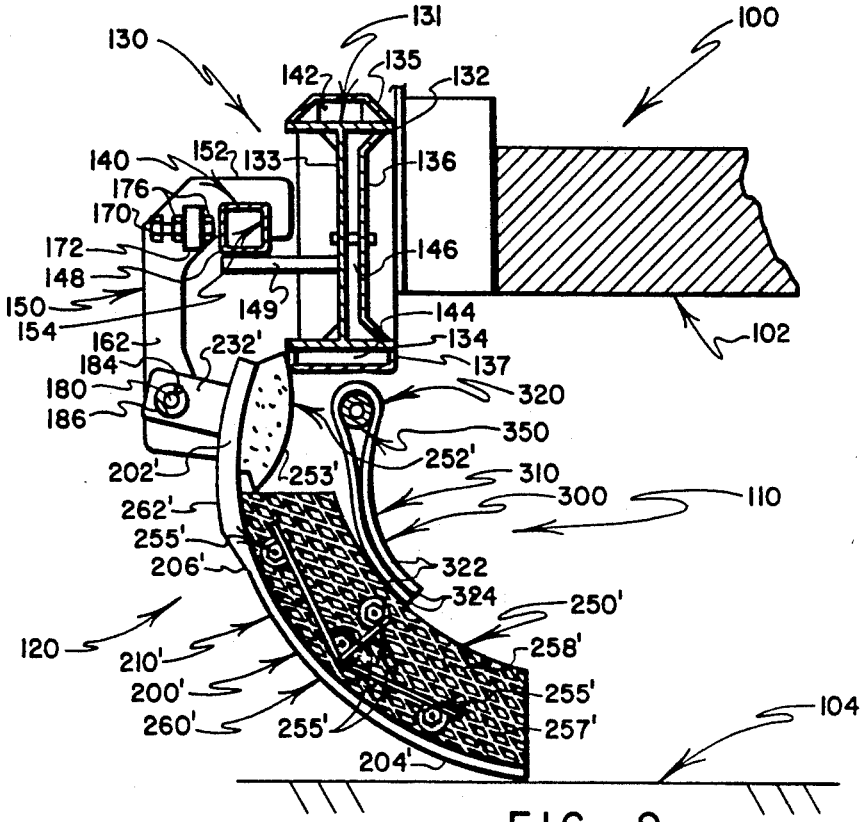
FIG. 9 is a sectional view, on an enlarged scale, of another form of curved door component that embodies features of the preferred practice of the present invention, as seen generally from a line 9—9 in FIG. 2.
Figure 11:
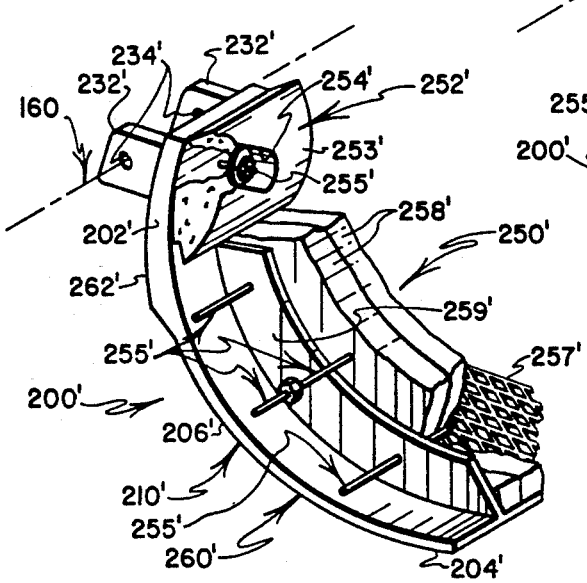
FIG. 11 is a perspective view that is similar to FIG. 10 but with portions of the door component being broken away to permit underlying details of construction to be viewed.
Figure 10:
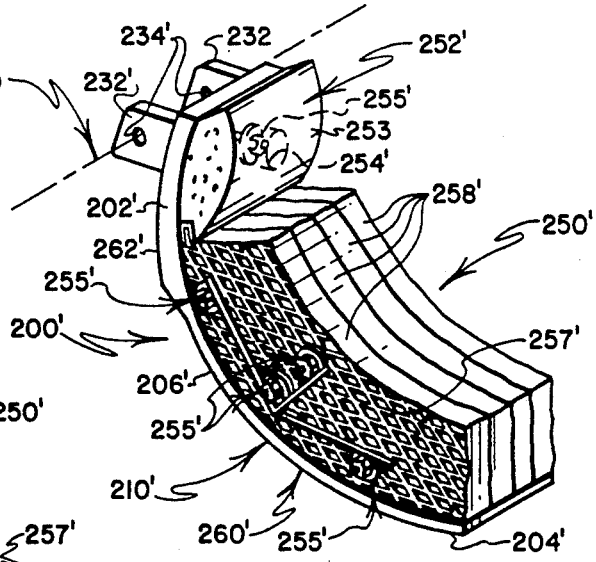
FIG. 10 is a perspective view of the curved door component of FIG. 9, with the view showing principally inner features thereof.

Referring to FIGS. 9–11, blanket-like layers of insulation 258' are assembled and are cut to form a desired curved shape that gives a thickness of about six inches of insulation lining for the inner surface of the curved backing structure 260' of the door component 200'. Threaded fasteners 255' are installed through holes that are formed in a centrally upstanding rib 259' (see FIGURE 11) that is a part of the one piece nodular iron casting that preferably is used to form the curved backing structure 260'; and, pieces of expanded metal 257' are clamped by the threaded fasteners 255' to securely mount the layers of insulation 258'.

In preferred practice, the hard, curved-face bodies of insulation 252, 252' are formed from relatively insulation that contains alumina compounds and clay, and is of the general type sold by Wahl Refractories, Inc. of Fremont, Ohio under the trademark SIFCA. In preferred practice, the insulation board 256 that lines central portions of the inner curved surface of the backing structure 260 contains aluminosilicate and is of the general type sold by Thermal Ceramics of Augusta, Ga. under the trademark ULTRAFELT. In preferred practice, the relatively flexible, blanket-like bats of insulation material 258, 258', 310 that are used to line portions of the interior surfaces of the curved door components 200, 200', and that is used to form the curtain of insulation 300, contains refractory fibers and is of the general type sold by Thermal Ceramics of Augusta, Ga. under the trademark KAOWOOL.

While the aforedescribed array of curved door components 200, 200' accompanied by the aforedescribed array of insulation bat components 310 has been described as "extending for substantially the full length of the furnace opening 110," those who are skilled in the art readily will understand that features of the described insulated door system of the present invention can be employed to provide thermally efficient closures for only selected portions of entry openings for furnaces and other apparatus wherein it is desirable to admit articles to a treatment chamber. Likewise, while the curved door components 200 have been described as being deployed along entry opening portions other than end regions of entry openings, it will be understood that these undoubtedly exist applications in which the components 200 are quite suitable for use in end-of-the-opening locations; and, while the curved door components 200' have been described as being deployed near end regions of entry openings, these narrow, thickly insulated components often are quite suitable for use at other than end-of-the-opening locations.

Although the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. An energy efficient entry door system for admitting elongate articles to a treatment chamber wherein a temperature substantially different from that of ambient air is maintained, with the entry door system serving to open and close at least a selected portion of a substantially horizontally extending entry opening that communicates from outside of the treatment chamber to inside the treatment chamber, comprising:

a) support means including structure extending substantially horizontally at a location near the outside the entry opening along such upper structure as defines the top of a portion of an entry opening portion is to be opened and closed by the entry door system;

b) door component means including a plurality of door components i) for being pivotally connected to the support means and ii) for depending substantially vertically therefrom in a manner that causes the door components to normally be biased by gravity toward a closed position of engagement with such lower structure as defines the bottom of said portion of the entry opening;

c) connection means i) for establishing a pivotal connection between the door component means and the support means to enable the door component means to pivot about a substantially horizontal axis that extends substantially parallel to the support means at a location that is outside the entry opening, ii) for positioning said plurality of door components so as to extend in a substantially contiguous, side-by-side array that bridges the horizontal length of said portion of the entry opening, and iii) for enabling the door components to pivot independently between their "closed" positions and "open" positions that enable an elongate article to move along a path of travel that extends from outside then entry opening through the bottom of said portion of the entry opening and into a treatment chamber that is located inside the entry opening; and, d) wherein each of the door components has a rigid backing member that includes i) upper end region means for defining an upper end region that is connected by the connection means to said support means, ii) lower end region means for defining a lower end region that engages said lower structure when the door component is closed, and iii) central region means for defining an inwardly curved, outwardly convex central region that extends progressively inwardly as it extends from its connection with the upper end region to its connection with the lower end region, with said lower end region means being configured to cause the lower end region to be positioned relatively inwardly with respect to the entry opening at all times regardless of whether the door component is "closed" or "open," with said upper end region means being configured to cause the upper end region to be positioned relatively outwardly with respect to the entry opening at all times regardless of whether the door component is "closed" or "open," and with said central region means being configured so that the central region defines outwardly facing engagement surface means that extends at least partially through the furnace entry opening for being engaged by an elongate article that is being moved through the entry opening, with said engagement surface being inclined inwardly as it extends at least partially through the furnace entry opening so that as the elongate article is moved through the entry opening, the engagement of the elongate article with the engagement surface causes the door component to pivot open and to remain open only to the extent needed to permit passage through the entry opening of the elongate article.

2. The entry door system of claim 1 wherein:

a) the support structure defines an elongate mounting formation that extends substantially horizontally at a location near the outside of the entry opening and along said upper structure so as to substantially parallel a front face of the entry opening but at a distance spaced outwardly therefrom; and, b) the connection means includes a plurality of connection members that each are pivotally connected to a separate one of the door components, and that each are connectable separately to the elongate mounting formation so as to establish individual connections of each of the door components to the support means.

3. The entry door system of claim 2 wherein the connection means additionally includes threaded fastening means connected to each of the connection members for being tightened into clamping engagement with the elongate mounting formation so as to individually, releasably connect each of the door components and its associated connection member to the elongate support means.

4. The entry door system of claim 2 wherein the support structure includes:

a) a structural steel beam that extends substantially horizontally at a location near the outside of the entry opening; and, b) chamber defining means extending along the steel beam for circulation of cooling water therethrough for cooling at least selected portions of the steel beam.

5. The entry door system of claim 4 wherein:

a) the steel beam is an I-beam that has top and bottom flanges that are interconnected by a substantially vertically extending web that has inner and outer opposed surfaces; and, b) the elongate mounting formation is defined by a length of steel tubing that is connected to the outer surface of the web by spacing means for positioning the tubing outwardly from the outer surface of the upstanding web.

6. The entry door system of claim 1 wherein the rigid backing member is formed from nodular cast iron.

7. The entry door system of claim 1 wherein the rigid backing member is formed as an assembly of a plurality of components that, taken together, define a smooth curve that extends from the upper end region through the central region to the lower end region.

8. The entry door system of claim 7 wherein the smooth curve that is defined by the plurality of components is a segment of a circle of substantially uniform radius.

9. The entry door system of claim 8 wherein the circle segment extends through at least about ninety degrees such that the upper end region includes a segment that has a substantially vertically extending tangent, while the lower end region includes a segment that has a substantially horizontally extending tangent.

10. The entry door system of claim 8 wherein the substantially uniform radius is greater than half the height of the entry opening.

11. The entry door system of claim 8 wherein the substantially uniform radius is less than the full height of the entry opening.

12. The entry door system of claim 1 wherein:

a) the support means defines door-mating formation means for extending across an upper part of the entry opening portion that is to be opened and closed by the entry door system, with the door-mating formation means being located in outwardly-spaced relationship to such upper structure as defines the top of said entry opening portion;

b) the connection means defines said substantially horizontal axis about which the door components pivot at a location spaced outwardly by a substantially constant distance from the door-mating formation means;

c) each of the door components is provided with insulation means that is connected thereto for lining at least a portion of the inwardly facing surface of the rigid backing member; and, d) the insulation means that is connected to each of the door components includes a relatively rigid upper end region formation of refractory insulation that is connected to the upper end region of the associated rigid backing member, with the rigid upper end region formation having an inwardly-facing surface that is curved so as to form a segment of an imaginary cylinder that is concentric about said substantially horizontal axis and that has a radius that is only slightly less than the distance between said axis and said door mating formation means so that only a thin space is created between the curved, inwardly-facing surface and the door mating formation means, which thin space remains substantially uniform as the associated door component pivots about said substantially horizontal axis in moving between its closed and open positions.

13. The entry door system of claim 12 wherein the relatively rigid formation of refractory insulation contains alumina compounds and clay.

14. The entry door system of claim 1 wherein a) each of the door components is provided with insulation means that is connected thereto for lining at least a portion of the inwardly facing surface of the rigid backing member; and, d) the insulation means that is connected to each of the door components includes at least one bat of relatively soft refractory insulation that extends along so as to line the inner surface of the central region of the rigid backing member.

15. The entry door system of claim 14 wherein the at least one bat of refractory insulation is connected to the central region near the upper end thereof.

16. The entry door system of claim 14 wherein the at least one bat of refractory insulation is connected to the central region by providing overlying layers thereof that are compressively restrained between at least a pair of spaced expanded metal formations that are connected to the inner surface of the central region of the backing member.

17. The entry door system of claim 16 wherein the overlying layers of refractory insulation are also connected to at least said pair of spaced expanded metal formations by means of threaded fasteners that extend through the overlying layers and serve to clamp said pair of spaced expanded metal formations toward each other.

18. The entry door system of claim 14 wherein the at least one bat of relatively soft refractory insulation contains refractory ceramic fibers.

19. The entry door system of claim 14 wherein, in addition to the at least one bat of relatively soft refractory insulation that serves to line the inner surface of the central region of the backing member, interposed between said inner surface and said bat is a layer of relatively soft refractory insulation material that is clamped against said inner surface of the central region by metal fastening means.

20. The entry door system of claim 19 wherein the relatively soft refractory insulation material contains aluminosilicate.

21. The entry door system of claim 1 wherein:

a) each of the door components is provided with insulation means that is connected thereto for lining at least a majority of the inwardly facing surface of the rigid backing member; and, b) at least one of the door components which is expected to not be opened as often as a door component that is adjacent thereto is provided with relatively thick insulation lining at least the central region of the inwardly facing surface of the rigid backing member to help block unwanted transfer of thermal energy from between the at least one door component when it does not open and an adjacent door component that does open during passage of an elongate article through the entry opening.

22. The entry door system of claim 21 wherein the thickness of the relatively thick insulation lining is at least about six inches.

23. The entry door system of claim 21 wherein said at least one of the door components which is expected not to be opened as often as an adjacent door component is configured to extend horizontally for only about one half of the distance that said adjacent door component extends horizontally, whereby said at least one door component functions to open and close only about one half of the entry opening area that is opened and closed by said adjacent door component.

24. The entry door system of claim 1 additionally including auxiliary support means extending substantially horizontally at a location spaced beneath such upper structure as defines the top of the entry opening, and insulation curtain means connected to the auxiliary support means for depending along inside surface portions of the door components for assisting the door components in blocking the unwanted transfer of thermal energy through the entry opening.

25. The entry door system of claim 24 wherein the insulation curtain means includes a blanket of insulation that has a central portion that is wrapped about portions of the auxiliary support means for supporting other portions of the blanket of insulation to depend along said inside surface portions of the door components.

26. The entry door system of claim 25 wherein the auxiliary support means includes at least one length of steel pipe that extends along but is spaced slightly beneath such upper structure as defines the top of the entry opening, and the blanket of insulation is of U-shaped cross section in that is has a pair of opposed ends that are positioned adjacent each other and are connected by said central portion, and said central portion has a generally U-shaped configuration that wraps about the length of steel pipe.

27. The entry door system of claim 26 wherein he blanket is formed from a side-by-side array of bats of flexible insulation that each have a central portion wrapped about the length of steel pipe in the manner aforedescribed, and with junctures between adjacent ones of the bats providing substantially no gap therebetween.

28. The entry door system of claim 27 wherein the junctures between adjacent ones of the bats of insulation that form the curtain are deliberately misaligned with junctures between adjacent ones of the door components so that each of the bats of insulation that form the curtain bridge at least portions of an adjacent pair of said door components.

29. The entry door system of claim 26 wherein said length of steel pipe has its opposite ends connected to receive and circulate therethrough a flow of cooling water.

30. The entry door system of claim 29 wherein the support means includes structure that defines at least one path of flow for cooling water that extends along the length of the support means, and said length of steel pipe communicates with said path of flow for receiving cooling water therefrom and returning cooling water thereto.

31. An energy efficient entry door system for admitting elongate articles to a heating chamber of an industrial furnace wherein a temperature that is very substantially above that of ambient air is maintained, with the entry door system serving to open and close at least a selected portion of a substantially horizontally extending entry opening that communicates from outside of the furnace chamber to inside the furnace chamber, comprising:

a) first support means including first support structure extending substantially horizontally at a location near the outside the entry opening along such upper structure as defines the top of a portion of an entry opening portion is to be opened and closed by the entry door system;

b) door component means including a plurality of door components i) for being pivotally connected to the first support means and ii) for depending substantially vertically therefrom in a manner that causes the door components to normally be biased by gravity toward a closed position of engagement with such lower structure as defines the bottom of said portion of the entry opening;

c) connection means i) for establishing a pivotal connection between the door component means and the first support means to enable the door component means to pivot about a substantially horizontal axis that extends substantially parallel to the support means at a location that is outside the entry opening, ii) for positioning said plurality of door components so as to extend in a substantially contiguous, side-by-side array that bridges the horizontal length of said portion of the entry opening, and iii) for enabling the door components to pivot independently between their "closed" positions and "open" positions that enable an elongate article to move along a path of travel that extends from outside the entry opening through the bottom of said portion of the entry opening and into a furnace chamber that is located inside the entry opening;

d) wherein each of the door components has a rigid backing member that includes i) upper end region means for defining an upper end region that is connected by the connection means to said first support means, ii) lower end region means for defining a lower end region that engages said lower structure when the door component is closed, and iii) central region means for defining an inwardly curved, outwardly convex central region that extends progressively inwardly as it extends from its connection with the upper end region to its connection with the lower end region, with said lower end region means being configured to cause the lower end region to be positioned relatively inwardly with respect to the entry opening at all times regardless of whether the door component is "closed" or "open," with said upper end region means being configured to cause the upper end region to be positioned relatively outwardly with respect to the entry opening at all times regardless of whether the door component is "closed" or "open," and with said central region means being configured so that the central region defines outwardly facing engagement surface means that extends at least partially through the furnace entry opening for being engaged by an elongate article that is being moved through the entry opening, with said engagement surface being inclined inwardly as it extends at least partially through the furnace entry opening so that as the elongate article is moved through the entry opening, the engagement of the elongate article with the engagement surface causes the door component to pivot open and to remain open only to the extent needed to permit passage through the entry opening of the elongate article;

e) first insulation means including a backing of insulation that extends along inwardly facing surface portions of the rigid backing member;

f) second support means including second support structure extending substantially horizontally beneath such upper structure as defines the top of the entry opening; and, g) second insulation means including a curtain of insulation suspended from said second support means for depending alongside inner portions of the door components.

32. The entry door system of claim 31 wherein:

a) the first support means defines an elongate mounting formation that extends substantially horizontally at a location near the outside of the entry opening and along said upper structure so as to substantially parallel a front face of the entry opening but at a distance spaced outwardly therefrom; and, b) the connection means includes a plurality of connection members that each are pivotally connected to a separate one of the door components, and that each are connectable separately to the elongate mounting formation so as to establish individual connections of each of the door components to the first support means.

33. The entry door system of claim 32 wherein the connection means additionally includes threaded fastening means connected to each of the connection members for being tightened into clamping engagement with the elongate mounting formation so as to individually, releasably connect each of the door components and its associated connection member to the first support means.

34. The entry door system of claim 32 wherein the first support means includes:

a) a structural steel beam that extends substantially horizontally at a location near the outside of the entry opening; and, b) chamber defining means extending along the steel beam for circulation of cooling water therethrough for cooling at least selected portions of the steel beam.

35. The entry door system of claim 34 wherein:

a) the steel beam is an I-beam that has top and bottom flanges that are interconnected by a substantially vertically extending web that has inner and outer opposed surfaces; and, b) the elongate mounting formation is defined by a length of steel tubing that is connected to the outer surface of the web by spacing means for positioning the tubing outwardly from the outer surface of the upstanding web.

36. The entry door system of claim 31 wherein the rigid backing member is formed from nodular cast iron.

37. The entry door system of claim 31 wherein the rigid backing member is formed as an assembly of a plurality of components that, taken together, define a smooth curve that extends from the upper end region through the central region to the lower end region.

38. The entry door system of claim 37 wherein the smooth curve that is defined by the plurality of components is a segment of a circle of substantially uniform radius.

39. The entry door system of claim 38 wherein the circle segment extends through at least about ninety degrees such that the upper end region includes a segment that has a substantially vertically extending tangent, while the lower end region includes a segment that has a substantially horizontally extending tangent.

40. The entry door system of claim 38 wherein the substantially uniform radius is greater than half the height of the entry opening.

41. The entry door system of claim 38 wherein the substantially uniform radius is less than the full height of the entry opening.

42. The entry door system of claim 31 wherein:

a) the first support means defines door-mating formation means for extending across an upper part of the entry opening portion that is to be opened and closed by the entry door system, with the door-mating formation means being located in outwardly-spaced relationship to such upper structure as defines the top of said entry opening portion;

b) the connection means defines said substantially horizontal axis about which the door components pivot at a location spaced outwardly by a substantially constant distance from the door-mating formation means;

c) each of the door components is provided with insulation means that is connected thereto for lining at least a portion of the inwardly facing surface of the rigid backing member; and, d) the insulation means that is connected to each of the door components includes a relatively rigid upper end region formation of refractory insulation that is connected to the upper end region of the associated rigid backing member, with the rigid upper end region formation having an inwardly-facing surface that is curved so as to form a segment of an imaginary cylinder that is concentric about said substantially horizontal axis and that has a radius that is only slightly less than the distance between said axis and said door mating formation means so that only a thin space is created between the curved, inwardly-facing surface and the door mating formation means, which thin space remains substantially uniform as the associated door component pivots about said substantially horizontal axis in moving between its closed and open positions.

43. The entry door system of claim 42 wherein the relatively rigid formation of refractory insulation contains alumina compounds and clay.

44. The entry door system of claim 31 wherein:

a) each of the door components is provided with insulation means that is connected thereto for lining at least a portion of the inwardly facing surface of the rigid backing member; and, d) the insulation means that is connected to each of the door components includes at least one bat of relatively soft refractory insulation that extends along so as to line the inner surface of the central region of the rigid backing member.

45. The entry door system of claim 44 wherein the at least one bat of refractory insulation is connected to the central region near the upper end thereof.

46. The entry door system of claim 44 wherein the at least one bat of refractory insulation is connected to the central region by providing overlying layers thereof that are compressively restrained between at least a pair of spaced expanded metal formations that are connected to the inner surface of the central region of the backing member.

47. The entry door system of claim 46 wherein the overlying layers of refractory insulation are also connected to at least said pair of spaced expanded metal formations by means of threaded fasteners that extend through the overlying layers and serve to clamp said pair of spaced expanded metal formations toward each other.

48. The entry door system of claim 44 wherein the at least one bat of relatively soft refractory insulation contains refractory ceramic fibers.

49. The entry door system of claim 44 wherein, in addition to the at least one bat of relatively soft refractory insulation that serves to line the inner surface of the central region of the backing member, interposed between said inner surface and said bat is a layer of relatively soft refractory insulation material that is clamped against said inner surface of the central region by metal fastening means.

50. The entry door system of claim 49 wherein the relatively soft refractory insulation material contains aluminosilicate.

51. The entry door system of claim 1 wherein:

a) the backing of insulation that extends along inwardly facing surface portions of the rigid backing member includes insulation means that is connected to its associated door component for lining at least a majority of the inwardly facing surface of the associated rigid backing member; and, b) at least one of the door components which is expected to not be opened as often as a door component that is adjacent thereto is provided with relatively thick insulation lining at least the central region of the inwardly facing surface of the rigid backing member to help block unwanted transfer of thermal energy from between the at least one door component when it does not open and an adjacent door component that does open during passage of an elongate article through the entry opening.

52. The entry door system of claim 51 wherein the thickness of the relatively thick insulation lining is at least about six inches.

53. The entry door system of claim 51 wherein said at least one of the door components which is expected not to be opened as often as an adjacent door component is configured to extend horizontally for only about one half of the distance that said adjacent door component extends horizontally, whereby said at least one door component functions to open and close only about one half of the entry opening area that is opened and closed by said adjacent door component.

54. The entry door system of claim 31 wherein the curtain of insulation is connected by insulation suspension means to said second support means for depending therefrom at a location near the entry opening and extending alongside inner portions of the door components for being engaged by such ones of the door components as open to admit an elongate article to the furnace chamber.

55. The entry door system of claim 54 wherein the curtain suspension means includes at least one length of steel pipe, and the curtain of insulation is formed by a blanket of insulation that is of U-shaped cross section in that it has a pair of opposed ends that are positioned adjacent each other and that are connected by a U-shaped central portion that wraps about the length of steel pipe.

56. The entry door system of claim 55 wherein the blanket of insulation is formed from a side-by-side array of bats of flexible insulation that each are wrapped about the steel pipe in the manner aforedescribed, and with junctures between adjacent ones of the bats providing substantially no gap therebetween.

57. The entry door system of claim 56 wherein the junctures between adjacent ones of the bats of insulation that form the curtain are deliberately misaligned with junctures between adjacent ones of the door components so that each of the bats of insulation that form the curtain bridge at least portions of an adjacent pair of said door components.

58. The entry door system of claim 55 wherein said length of steel pipe has its opposite ends connected to receive and circulate therethrough a flow of cooling water.

59. The entry door system of claim 58 wherein the support means includes structure that defines at least one path of flow for cooling water that extends along the length of the support means, and said length of steel pipe communicates with said path of flow for receiving cooling water therefrom and returning cooling water thereto.

60. The entry door system of claim 31 wherein the horizontal length of the furnace entry opening is substantially fully opened and closed by the door components, and wherein the majority of the components are selected to have a horizontal measurement extending along the opening that is within the range of about 1/25th to about 1/40th of said horizontal length.

61. The entry door system of claim 60 wherein, at locations near opposite ends of the horizontal length of the furnace entry opening, relatively narrow door components are provided that have a horizontal measurement extending along the opening that is within the range of about 1/50th to about 1/80th of said horizontal length, and said relatively narrow door components each are provided with a backing of insulation that is of at least about six inches in thickness.

62. An energy efficient closure for minimizing heat loss through an elongate, horizontally extending furnace entry opening that is utilized to admit elongate charges of material including steel slabs, billets and blooms, to the interior of a furnace, such as a reheat furnace, comprising:

a) door means including a plurality of depending, individually mounted, independently pivoted, inwardly curved, insulated door components arranged in a side-by-side array for selectively closing the furnace entry opening with each of the door components having upper end region means for remaining relatively outwardly with respect to the furnace entry opening so as to extend closely alongside such furnace structure as defines the top side of the furnace entry opening, having lower end region means for remaining relatively inwardly with respect to the furnace entry opening so as to be engageable with such furnace structure as extends along a bottom side of the furnace entry opening, and having inwardly curved central region means for extending between and connecting said upper end region means and said lower end region means, and for defining inwardly curved engagement surface means that extends at least partially through the furnace entry opening for being engaged by elongate charges of material that pass through the furnace entry opening, with the door components each being configured to be biased by gravity toward a normally closed position wherein the lower end region means engages such furnace structure as extends along the bottom side of the furnace entry opening to close the furnace opening, and with said engagement of elongate charges of material with the door components causing engaged ones of the door components to be pivoted away from their normally closed positions but only to the extent that is needed to permit passage through the furnace entry opening of the elongate charges of material; and, b) auxiliary insulation means for defining a curtain of insulation that depends from a water-cooled support that extends horizontally beneath and along such furnace structure as defines the top side of the furnace entry opening, with the curtain being formed by a plurality of depending bats of insulation that are arranged in a substantially contiguous side-by-side array.

63. A door component for being utilized together with other substantially identical door components to selectively open and close at least a portion of a horizontally extending entry opening of a steel reheat furnace, through which entry opening elongate charges of material are admitted to the interior of the reheat furnace, wherein the door component comprises:

a) curved backing means formed from nodular cast iron:

i) for defining an upper end region that is adapted for pivotal connection to a suitable support that extends horizontally along such upper furnace structure as defines the top of the furnace entry opening, with the location of said pivotal connection causing the upper end region of the curved backing means to be positioned and to remain positioned relatively outwardly with respect to the furnace entry opening;

ii) for defining a lower end region for engaging such lower furnace structure as extends along the bottom of the furnace entry opening; and, iii) for defining an elongate, curved central region that connects smoothly with the upper end region at one end thereof, and that connects smoothly with the lower end region at the opposite end region thereof, with the curved backing means having concave inner surface means for facing toward the interior of the steel reheat furnace, and convex outer surface means for extending at least partially through the furnace entry opening and for being engaged by elongate charges of material during their passage through the furnace entry opening so that the door component will be "opened" only to the extent that is needed to permit such charges of material to pass through the furnace entry opening to be admitted to the interior of the reheat furnace;

b) insulation means for extending along at least a substantial portion of said concave inner surface and including at least one bat of flexible, fiber blanket refractory insulation material; and, c) insulation mounting means for connecting said insulation means to the curved backing means.

64. The door component of claim 63 additionally including support means pivotally connected to the upper end region of the curved backing means for connection to the steel reheat furnace and for pivotally mounting the door component on the furnace with the lower portions thereof extending through the furnace entry opening, and with the outer surface of the curved backing means providing an engagement formation that is engaged by bodies of steel being moved through the furnace entry opening so as to pivot the door component and lift its lower end region to the extent needed to permit the bodies of steel to pass through the furnace entry opening.

* * * * *